US005716008A

United States Patent [19]

Nottingham et al.

[11] Patent Number: 5,716,008

[45] Date of Patent: Feb. 10, 1998

[54] TRIGGER SPRAYER

[75] Inventors: John R. Nottingham, Hunting Valley; Richard O. McCarthy, Strongsville; Nick E. Stanca, Westlake; Dale A. Panasewicz, Strongsville, all of Ohio

[73] Assignee: Nottingham-Spirk Design Associates, Inc., Cleveland, Ohio

[21] Appl. No.: 610,310

[22] Filed: Mar. 4, 1996

[51] Int. Cl.[6] ..... B05B 9/43

[52] U.S. Cl. ..... 239/333; 239/330; 222/383; 222/333

[58] Field of Search ..... 239/333, 330, 239/463, 464, 468, 452, 490–3, 533.1, 546, 570, 601, 602, DIG. 12; 222/383, 333

[56] References Cited

U.S. PATENT DOCUMENTS

| | | | |
|---|---|---|---|
| 3,762,647 | 10/1973 | Tada | 293/321 |
| 3,973,700 | 8/1976 | Schmidt et al. | 222/153 |
| 3,995,774 | 12/1976 | Cooprider et al. | 222/207 |
| 4,082,223 | 4/1978 | Nozawa | 239/333 |
| 4,155,487 | 5/1979 | Blake | 222/207 |
| 4,199,083 | 4/1980 | LoMaglio | 222/207 |
| 4,204,614 | 5/1980 | Reeve | 222/153 |
| 4,230,277 | 10/1980 | Tada | 239/333 |
| 4,260,079 | 4/1981 | Cary et al. | 222/209 |
| 4,273,290 | 6/1981 | Quinn | 239/493 |
| 4,558,821 | 12/1985 | Tada et al. | 239/333 |
| 4,655,690 | 4/1987 | Boedecker et al. | 417/53 |
| 4,819,835 | 4/1989 | Tasaki | 239/333 |
| 4,858,788 | 8/1989 | Meckenstock | 222/207 |
| 4,898,307 | 2/1990 | Tiramani | 239/333 |
| 4,911,361 | 3/1990 | Tada | 239/1 |
| 4,958,754 | 9/1990 | Dennis | 239/333 |
| 5,299,717 | 4/1994 | Geier | 239/333 |
| 5,303,867 | 4/1994 | Peterson | 239/333 |
| 5,341,965 | 8/1994 | Maas et al. | 222/340 |
| 5,356,049 | 10/1994 | Harris et al. | 222/383 |
| 5,385,302 | 1/1995 | Foster et al. | 239/333 |
| 5,402,916 | 4/1995 | Nottingham et al. | 222/134 |

FOREIGN PATENT DOCUMENTS

| | | | |
|---|---|---|---|
| 117898 | 9/1984 | European Pat. Off. | 239/333 |
| 3124441 | 6/1982 | Germany | 239/333 |
| 3314021 | 10/1984 | Germany | 239/333 |

*Primary Examiner*—Andres Kashnikow
*Assistant Examiner*—Lisa Ann Douglas

[57] ABSTRACT

A manually operable sprayer mountable on a supply container comprises a pump cylinder supporting a cylindrical, rollable pump diaphragm having a closed end coaxial with the cylinder and linearly axially displaceable toward and away from the cylinder by a trigger and pump actuator assembly including a pivotal trigger interconnected with a pump actuator for pivotal displacement of the trigger to be translated into linear axial displacement of the actuator which is connected to the end wall of the pump diaphragm. The component parts are enclosed in a housing defined by a pair of hingedly connected housing members, and a retainer member by which the sprayer is mountable on a supply container by a threaded cap either supports the component parts as a unitary assembly or interengages with the housing to cooperatively support the component parts therewith.

90 Claims, 11 Drawing Sheets

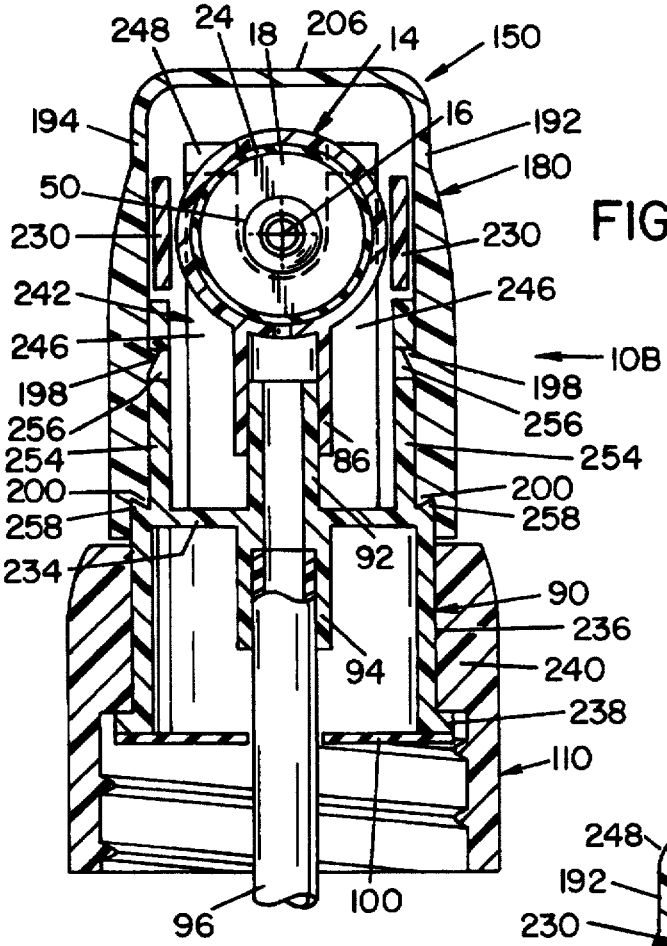
FIG. 12
FIG. 13
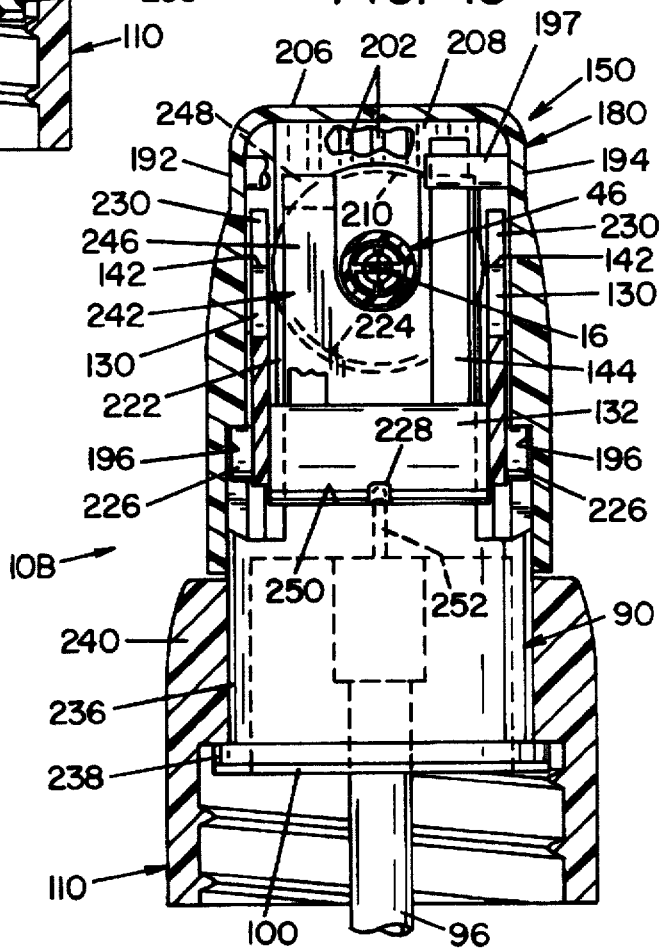

TRIGGER SPRAYER

BACKGROUND OF THE INVENTION

This invention relates to the art of manually operable trigger sprayers and, more particularly, to improvements in such sprayers lending to a more economically production thereof and improved efficiency with respect to assembly and operation thereof.

Trigger operated devices for discharging fluid from a supply container in the form of a spray are well known in the prior art. Generally, such trigger sprayers include a pump in the form of a piston and cylinder or defined by a collapsible and expandable bellows or bladder component and employ a spring or the resiliency of the pump material to provide a return force for the pump following the discharge of fluid therefrom. Such trigger sprayers further include valving for controlling the flow of fluid into and out of the pump chamber, and a nozzle for discharging the fluid, generally in the form of a spray. A number of disadvantages are attendant to such trigger sprayers heretofore provided including a considerable amount of friction between piston and cylinder pump components due to the necessary fluid-tight seal therebetween. This friction together with potential binding interference between the piston and cylinder increase the energy required to operate the trigger dispenser and thus the spring energy required to provide the return force. Another disadvantage resides in the fact that the discharge conduit or passageway between the pump and nozzle generally requires a drastic change in the direction of the discharge flow, anywhere from 45° to 180°, and the resistance to flow created by such directional change further increases the energy required to operate the spray dispenser. Moreover, such directional change with respect to discharge flow adds to the structural complexity of the spraying device.

While efforts have been made to avoid directional change with respect to the discharged fluid in a trigger sprayer, such as shown for example in U.S. Pat. No. 4,199,083 to LoMaglio and U.S. Pat. No. 5,303,867 to Peterson, other problems are attendant to the structure and operation of these devices. In this respect, for example, lateral collapsing of the resilient bladder in LoMaglio is limited and, therefore, both the quantity and pressure of fluid discharged from the pump per stroke of the trigger is undesirably limited. In the collapsible bellows arrangement of Peterson, the collapsing force against the bellows is arcuate and the bellows actuating component is physically attached to the dip tube which accordingly bends with each operation of the trigger mechanism. Such arcuate displacement of the bellows promotes a lateral force there against which, especially as the bellows weakens with age, promotes lateral displacement of the bellows between the opposite ends thereof and thus the potential of malfunctioning with respect to the desired compression of the bellows to achieve the pumping of fluid therefrom. Similarly, flexing of the dip tube transverse to its axis in response to each displacement of the trigger component promotes weakening thereof and again the potential for malfunction and/or a loss of structural integrity affecting efficient operation of the sprayer.

Yet another problem attendant to trigger sprayers heretofore available resides in the number of and/or structural complexity of the component parts of a trigger sprayer and/or the time and difficulty with respect to the assembly thereof, all of which adds to the cost of the spraying devices.

SUMMARY OF THE INVENTION

In accordance with the present invention, a trigger sprayer is provided which minimizes or overcomes the foregoing and other disadvantages of trigger sprayers heretofore available. In particular in this respect, a trigger sprayer in accordance with the invention has a pump comprising coaxial fixed and movable components which are linearly parallel to the discharge passage and nozzle components of the sprayer. Furthermore, the trigger component of the sprayer is interengaged with the-displaceable pump component such that the latter is linearly displaceable relative to the fixed component thus to avoid the imposing of any lateral forces on the movable component which could ultimately lead to a malfunction with respect to achieving the pumping stroke during a spray discharge operation. Still further, the linearly parallel relationship between the pump and discharge conduit is serially arranged, whereby there is no directional change with respect to fluid discharged from the pump to the discharge conduit and nozzle of the sprayer. This arrangement advantageously optimizes the quantity and pressure of fluid dispensed while minimizing the force required to displace the trigger to achieve a fluid-dispensing operation of the pump as well as minimizing the spring force required to provide a return force for the pump components. Preferably in accordance with this aspect of the invention, the pump includes an axially rollable diaphragm and an axially displaceable actuator interconnected with the trigger component such that displacement of the latter in the direction to achieve fluid dispensing causes linear axial displacement of the actuator in the opposite direction to achieve pumping of fluid in the pump through the discharge conduit and nozzle components of the sprayer.

In accordance with another aspect of the invention, the trigger and pump actuator components are pivotally interengaged by a live hinge therebetween and are structured for pivotal displacement of the trigger to impart linear axial displacement to the actuator parallel to the discharge axis of the sprayer. Further, the trigger preferably includes an integral spring finger arrangement for providing the return force for the pump following a liquid discharging operation and an integral valving arrangement by which the interior of a supply container on which the trigger sprayer is mounted is vented to atmosphere in response to displacement of the trigger in the pumping and return directions thereof.

In accordance with another aspect of the invention, the trigger sprayer includes a cylindrical pump having a discharge tube integral therewith and parallel to the cylinder axis, and an inlet to the cylinder including an inlet tube integral therewith. The pump diaphragm has an end received in the cylinder and providing a check valve arrangement with an opening communicating with the inlet tube, and the sprayer nozzle is mountable on the outer end of the discharge tube. The inlet tube is mountable on a tubular inlet conduit portion of a retainer member by which the trigger sprayer is removably mountable on a supply container, and the trigger and pump actuator assembly is pivotally supported on the inlet conduit as defined by the pump cylinder inlet tube or the retainer member. The retainer member supports the pump assembly, nozzle, and trigger assembly as a unit, and the unitary assembly is enclosed in a two-piece housing which is separate therefrom and adapted to be assembled thereabout and held in place with respect thereto through interengagement of the housing portions with the retainer member. In accordance with yet a further aspect of the invention, the two-piece housing has front and rear ends and comprises top and bottom housing portions interconnected by a live hinge therebetween at the rear-end of the housing. The top housing portion and the retainer member cooperatively support the trigger of the trigger and pump actuator assembly, and the retainer member and upper housing portion cooperatively engage with the pump diaphragm and cylinder to axially stabilize the latter. Further in accordance with this aspect of the invention, the retainer member interengages with the top housing portion to hold the bottom housing portion closed relative thereto, to support the pump assembly, nozzle and trigger assembly in assembled relationship with the top and bottom housing portions, and to preclude lateral outward deflection of the side walls of the top housing portion.

Accordingly, the component parts of a spraying device according to the present invention are structurally simple, minimum in number, and easy to assembly, thus optimizing economy with respect to production and assembly of the trigger sprayer while, at the same time, providing a structural interrelationship between the component parts which optimizes the efficiency with respect to the operation thereof and promotes a longer useful life with respect to the trigger sprayer.

It is accordingly an outstanding object of the present invention to provide an improved trigger sprayer of the type adapted to be removably mounted on a supply container for discharging fluid therefrom.

Another object is the provision of a trigger sprayer of the foregoing character having a trigger actuated pump in which displacement of the pump actuating component is linear, axial displacement in the same direction as the discharge of fluid from the trigger sprayer, thus to optimize efficiency with respect to operation of the pump and longevity with respect to the operating life thereof.

Yet another object is the provision of a trigger sprayer of the foregoing character wherein the trigger component is structurally interrelated with the pump actuating component in a manner whereby displacement of the trigger in one direction to achieve the dispensing of fluid from the sprayer results in displacement of the pump actuating member axially and linearly in the direction opposite to the direction of trigger displacement.

A further object is the provision of a trigger sprayer of the foregoing character wherein the trigger and pump actuating components are hingedly interconnected for pivotal displacement of the trigger relative to the sprayer about a trigger axis to impart linear axial displacement to the pump actuator component.

Still another object is the provision of a trigger sprayer of the foregoing character wherein the trigger component includes an integral spring finger arrangement providing the return force for the pump following a fluid discharging operation.

Yet a further object is the provision of a trigger sprayer of the foregoing character wherein a pump diaphragm and cylinder cooperatively provide valving for controlling the flow of fluid from the supply container to the pump chamber and wherein the trigger mechanism includes a unique valving arrangement for venting the interior of the supply container to atmosphere.

Another object is the provision of a trigger sprayer of the foregoing character wherein the pump components, nozzle component, and trigger and pump actuating components are interconnectible as an assembled unit and are adapted to be enclosed within a two-piece housing which is separate from and interengageable with the assembled unit through a retainer component.

Still another object is the provision of a trigger sprayer of the foregoing character which is comprised of a minimum number of component parts which are structured and structurally interrelated for ease in assembly, thus to provide economy with respect to manufacture of the trigger sprayer while promoting efficiency with respect to the mechanical operation thereof.

BRIEF DESCRIPTION OF THE DRAWINGS

The foregoing objects and others, will in part be obvious and in part pointed out more fully hereinafter in conjunction with the written description of preferred embodiments of the invention illustrated in the accompanying drawings in which:

FIG. 12 is a cross-sectional elevation view of the sprayer looking in the direction of line 12—12 in FIG. 11; and FIG. 13 is a cross-sectional elevation view of the sprayer looking in the direction of line 13—13 in FIG. 11.

DESCRIPTION OF PREFERRED EMBODIMENTS

Figure 1:
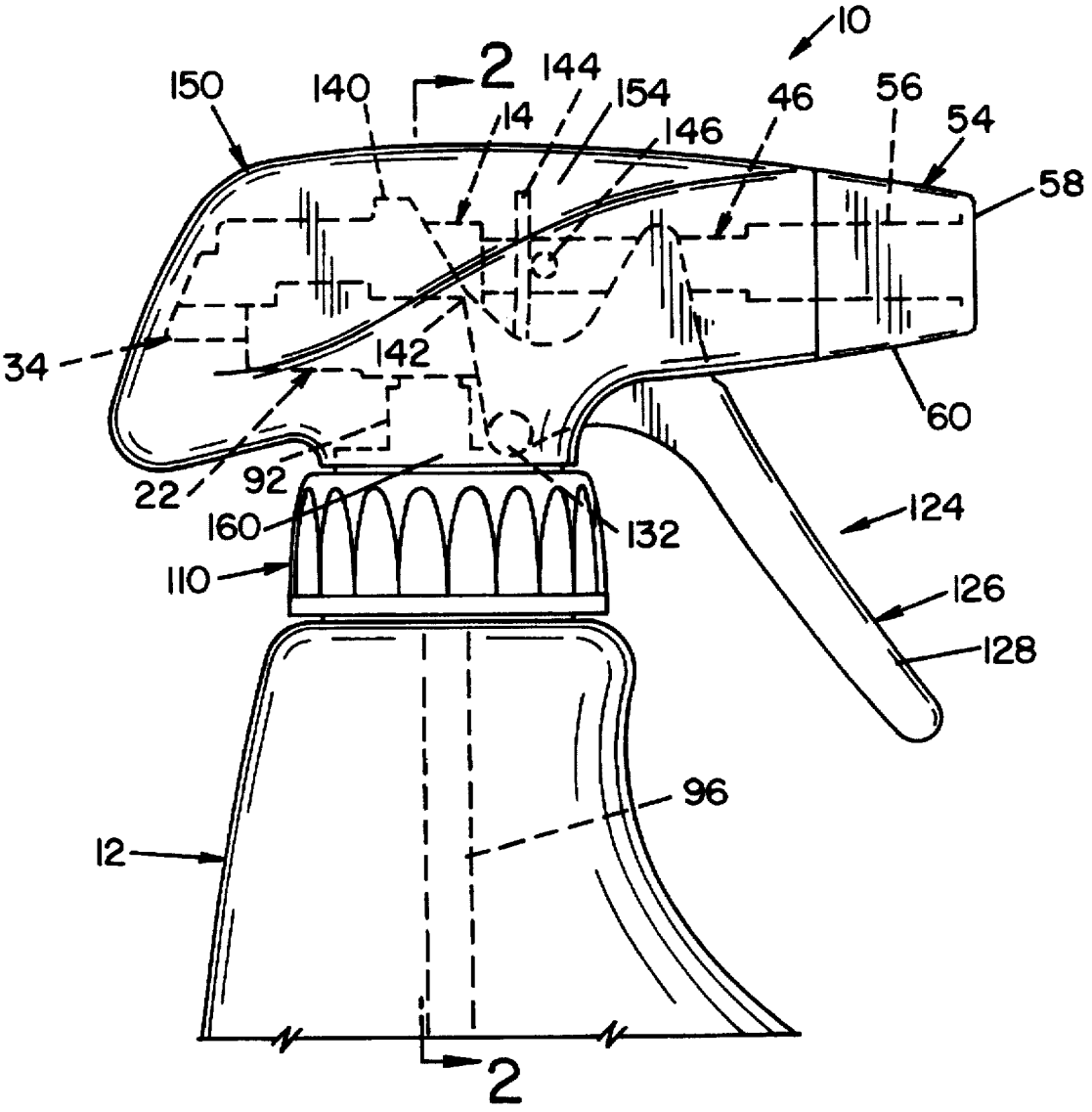
FIG. 1 is a side elevation view of a trigger sprayer in accordance with the invention.
Figure 2:
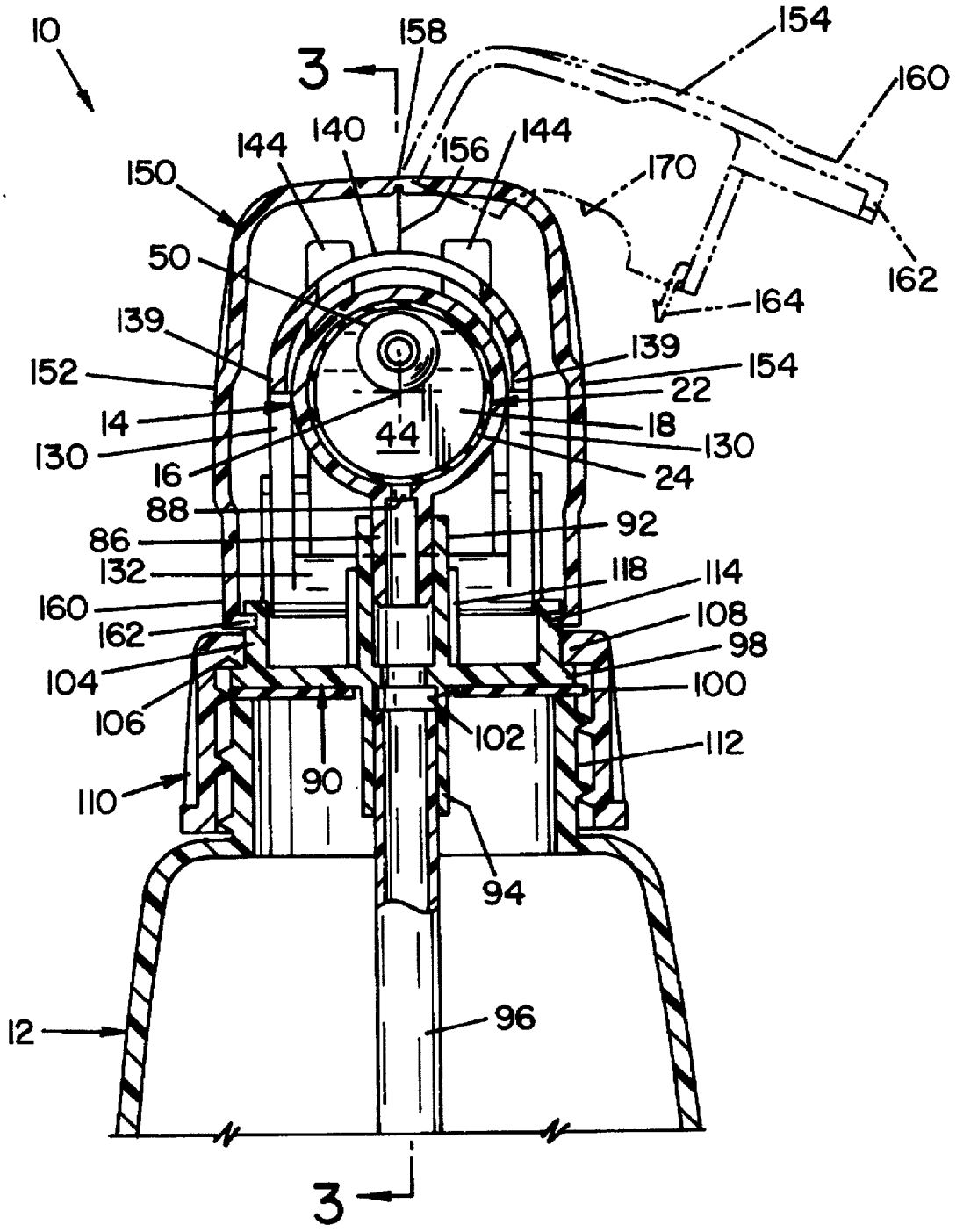
FIG. 2 is a cross-sectional elevation view of the sprayer taken along line 2—2 FIG. 1.

Referring now in greater detail to the drawings wherein the showings are for the purpose of illustrating preferred embodiments of the invention only and not for the purpose of limiting the invention, FIGS. 1–8 illustrate a trigger sprayer 10 adapted to be removably mounted on the open upper end of a supply container 12 from which fluid is pumped in response to operation of the trigger sprayer. Sprayer 10 includes a pump comprising a pump cylinder 14 having an axis 16, a front wall 18, and an open rear end 20. The pump further includes a pump diaphragm 22 of suitable rubber material having an open end 24 received in cylinder 14 adjacent front wall 18 thereof and having a closed end 26 spaced rearwardly of open end 20 of the cylinder. Diaphragm 22 includes a circular wall portion 28 extending rearwardly from end 24 thereof, and closed end 26 is defined by an end wall 30 transverse to axis 16 and a re-entrant portion 32 of side wall 28. A pump actuator element 34 to be described in greater detail hereinafter has an inner end 36 transverse to axis 16 and received in re-entrant portion 32, and the re-entrant portion of diaphragm wall 28 is provided with annular projection 38 engaging behind end 36 such that the re-entrant portion is axially displacable with actuator member 34 as will become apparent hereinafter. The portion of cylindrical wall 28 of the diaphragm received in cylinder 14 is of reduced diameter providing an annular flange 42 abutting against open end 20 of the cylinder to axially position inner end 24 of the diaphragm relative to front wall 18 of the pump cylinder. Cylinder 14 and diaphragm 22 cooperatively provide a variable volume pump chamber 44.

Pump cylinder 14 includes a discharge conduit 46 having an axis 48 parallel to and laterally spaced from cylinder axis 16. Conduit 46 has an axially inner end 50 in pump chamber 44 and an axially outer end 52 which receives and supports a nozzle component 54. More particularly in this respect, nozzle component 54 includes a support tube 56 coaxial with and suitably secured on the outer end of conduit 46, a front wall 58 transverse to axis 48 and a peripheral skirt portion 60 extending about tube 56. Front wall 58 is provided with a discharge opening 62 through which fluid from container 12 is pumped as will become apparent hereinafter. Inner end 50 of conduit 46 is tapered to provide a valve seat 64, and a discharge control valve element 66 is reciprocally supported in conduit 46 and has an inner end 68 adapted to move relative to seat 64 between engaged and disengaged positions relative thereto. The opposite end of the discharge conduit as defined by nozzle tube 56 receives a spinner element 70 having an outer end 72 coaxial with axis 48 and provided in a well known manner with an axial recess and ports 74 opening laterally thereinto so as to impart a swirling motion to fluid pumped through the outlet conduit and thence through discharge opening 62. A biasing spring 76 is disposed between valve element 66 and spinner element 70 and, preferably, is integral therewith. Spring 76 includes undulations 78 interconnected centrally between the opposite ends thereof by a straight portion 80 and connected respectively to the valve and spinner elements by straight portions 82. Thus, it will be appreciated that displacement of valve element 66 to the right in FIG. 3 from its seated position engaging valve seat 64 is against the bias of spring 76. Such displacement is, in a well known manner, responsive to fluid pressure in pump chamber 44, and upon such displacement from engagement with the valve seat, fluid flows across the valve element along grooves 84 extending longitudinally therealong. The fluid then flows through the discharge conduit to spinner element 70, laterally inwardly through ports 74 in the front end thereof and thence through discharge opening 62.

Sprayer 10 further includes an inlet conduit arrangement for connecting pump chamber 44 with fluid in supply container 12. More particularly, the inlet conduit includes an inlet tube 86 integral with and extending downwardly from pump cylinder 14 transverse to axis 16 thereof, and an inlet opening 88 in the cylinder wall which communicates the interior of tube 86 with pump chamber 44. The front end of pump diaphragm wall 28 overlies opening 88 and provides a check valve which permits fluid to enter pump chamber 44 from supply container 12 during the suction stroke of the pump and precludes the flow of fluid in pump chamber 44 through inlet opening 88 during the discharge stroke. A retainer member 90 provides a portion of the inlet conduit for the sprayer and, in this respect, includes an upper conduit portion 92 coaxial with and receiving inlet tube 86 therein, and a lower conduit portion 94 which receives the upper end of a dip tube 96 which extends downwardly into supply container 12. Retainer member 90 includes a radially outwardly extending peripheral flange 98 between the upper and lower conduit portions thereof, and flange 98 is adapted to rest on the open upper end of container 12 in connection with removably mounting the sprayer on the container as will become apparent hereinafter. A sealing gasket 100 underlies flange 98 and has a peripheral edge 102 about which air in the interior of container 12 is adapted to be vented to atmosphere as set forth hereinafter. The upper side of flange 98 is provided with an axially upwardly extending peripheral wall 104 spaced radially inwardly of the outer edge of the flange to provide a shoulder 106 adapted to interengage with the underside of a radially inwardly extending peripheral flange 108 on an interiorly threaded cap member 110 by which the sprayer is secured to the externally threaded neck portion 112 of container 12. The upper end of wall 104 of retainer member 90 terminates in a radially outwardly open peripheral recess 114 which serves the purpose set forth hereinafter. A portion 116 of flange 98 of retainer member 90 is axially offset upwardly and is provided with a pair of circumferentially spaced apart cradle members 118 having upwardly open arcuate recesses 120 therein for the purpose set forth hereinafter. Flange portion 116 is arcuate and is provided between cradle members 118 with a vent opening 122 for venting the interior of container 12 as set forth hereinafter.

Figure 6:
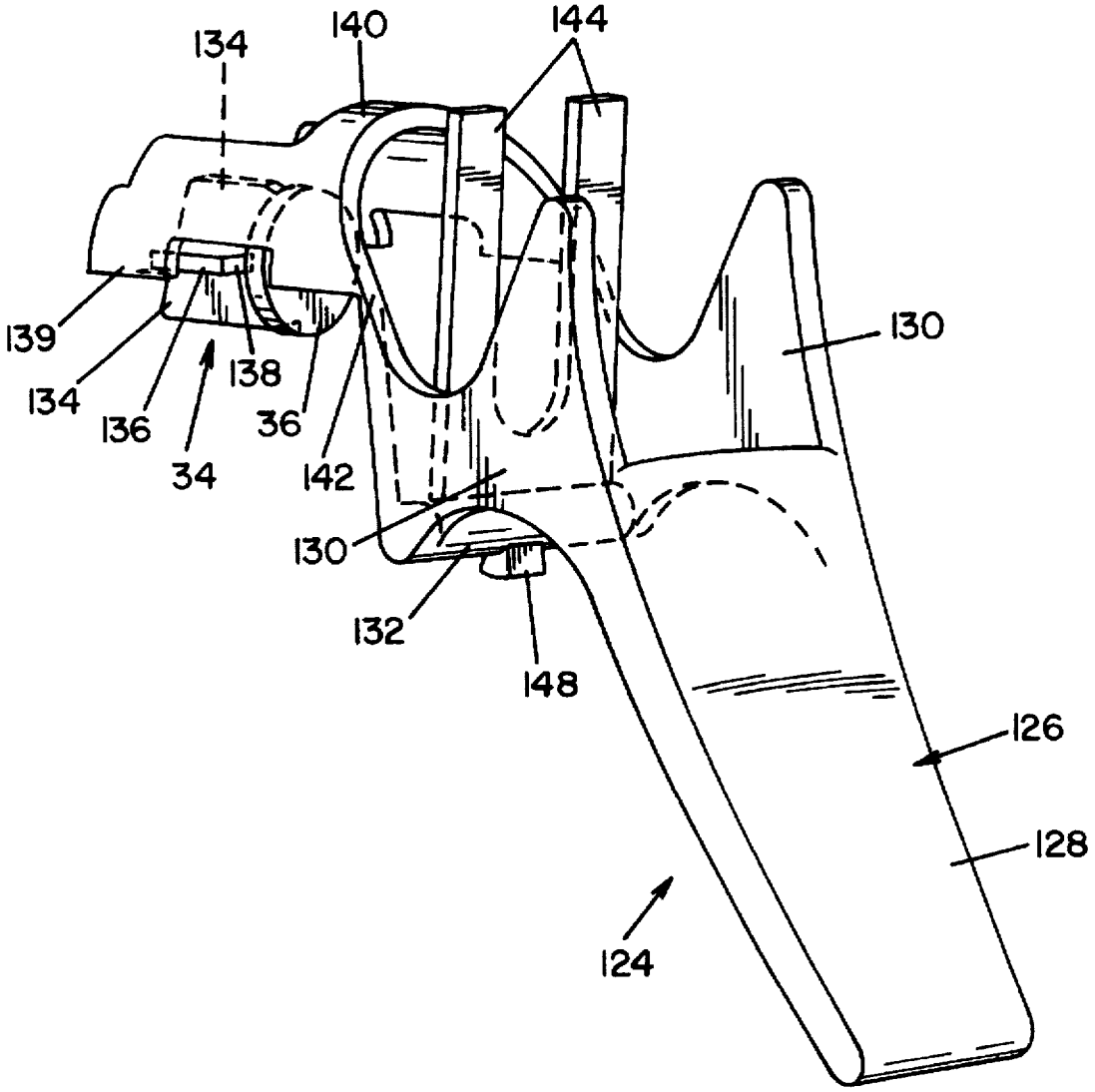
FIG. 6 is a front perspective view of the trigger and pump actuator of the sprayer.
Figure 7:
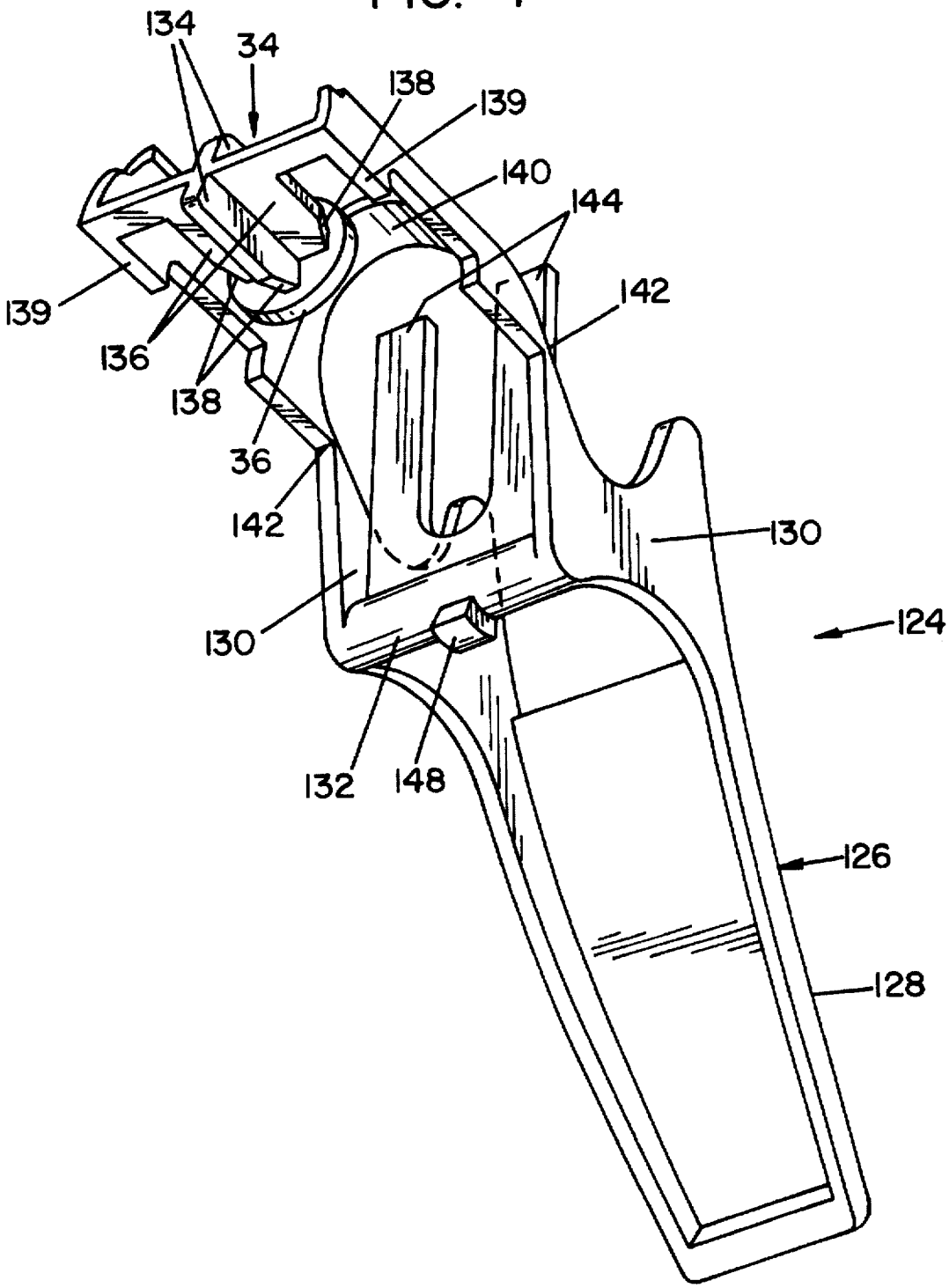
FIG. 7 is a rear perspective view of the trigger and pump actuator of the sprayer.

Displacement of the closed end of pump diaphragm 22 toward and away from front wall 18 of pump cylinder 14 is achieved by a trigger and pump actuating mechanism 124 of which diaphragm actuator 34 is an integral part. As best seen in FIGS. 6 and 7 together with FIGS. 2 and 3, the trigger and pump actuating mechanism includes a trigger 126 comprising an operating arm 128 and laterally spaced apart actuating arms 130, which arms 128 and 130 have corresponding outer ends respectively spaced below and above the axis of a trigger pivot pin 132. Pin 132 is between the lower or inner ends of arms 130 and is received in and pivotally supported by recesses 120 in cradle members 118 on retainer member 90. Actuating member 34 includes a cross-shaped support plate arrangement comprising vertical and horizontal plates 134 and 136, respectively, which are integral with inner end 36 of the actuating member which is in the form of an annular disk. The junctures between the plates and disk provide notches 138 which receive the annular projection 38 on the re-entrant wall portion 32 of the pump diaphragm as described hereinabove. Horizontal plates 136 extend laterally outwardly beyond the outer periphery of disk 36 and thence forwardly toward trigger 124 providing actuating legs 139 on laterally opposite sides of pump diaphragm 22 and pump cylinder 14. Legs 139 are interconnected at their forward ends for structural integrity by an arcuate bridging portion 140 which extends across the pump cylinder. The latter ends of the actuating legs are pivotally interconnected with the upper or outer ends of actuating arms 130 of trigger 126 by hinges 142 therebetween. Preferably, trigger and pump actuating mechanism 124 is a one-piece molding of suitable plastic material, whereby hinges 142 are live hinges between trigger 126 and pump actuator 34. Trigger 126 further includes a pair of spring fingers 144 integral with and extending upwardly from trigger pivot pin 132 on laterally opposite sides of discharge conduit 46, and the latter is provided with laterally outwardly extending projections 146 positioned forwardly of spring fingers 144 for interengagement therewith as will become apparent hereinafter. The underside of trigger pivot pin 132 is provided with a downwardly extending valving element 148 adapted to open and close vent opening 122 during operation of the sprayer as described hereinafter.

Figure 8:
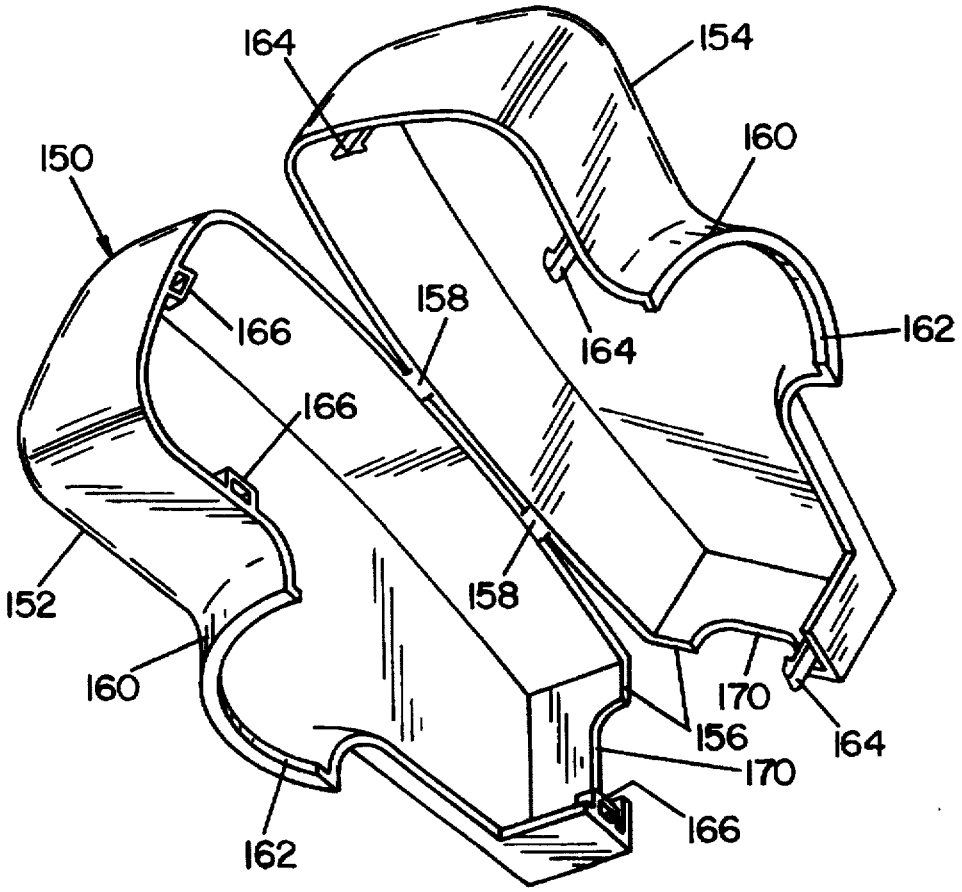
FIG. 8 is a perspective view of the housing assembly for the sprayer.

As will be appreciated from the description thus far, retainer member 90 supports the pump unit as defined by cylinder 14 and diaphragm 22, the outlet conduit and nozzle 54, and the trigger and pump actuating mechanism 124 as a unitary assembly mountable on supply container 12 by cap 110. In accordance with another aspect of the invention, this unitary assembly is adapted to be enclosed in a housing 150 which is separate therefrom. More particularly, in this respect as best seen in FIG. 8 together with FIGS. 2 and 3, housing 150 comprises a pair of housing members 152 and 154 having a line of juncture 156 therebetween in a vertical plane through axes 16 and 48. Preferably, the housing is a one-piece molding of suitable plastic material, and the housing members 152 and 154 are pivotally interconnected by one or more live hinges 158 provided along that portion of the line of juncture extending along the top of the housing. The bottom portions of the housing members are provided with arcuate shroud portions 160 having radially inwardly extending flanges 162 which, when the housing members are closed, engage in the radially outwardly open recess 114 in wall 104 of retainer member 90. The front portions of shrouds 160 are open to accommodate operating arm 128 of trigger 126. The line of juncture along the bottom of the housing adjacent the front end thereof and behind shroud portions 160 are provided with interengaging snap fastener arrangements by which the housing members when closed about the sprayer assembly and interengaged with retainer member 90 are interconnected in the closed position thereof. Any suitable fastener arrangement can be provided for this purpose such as that shown in FIG. 8 wherein housing member 154 is provided with projections 164 and housing member 152 is provided with latching components 166 for receiving and interlocking with projections 164. In order to preclude rotation of the housing relative to the sprayer assembly about the axis of the inlet conduit, the front end of each housing member is provided with a laterally inwardly extending wall transverse to axis 48 of the outlet conduit and having a laterally outwardly and downwardly extending recess 170. Each recess 170 engages the upper and corresponding outer side of nozzle outlet tube 56, and the recesses together interengage with the latter tube to stabilize the housing against lateral displacement relative thereto.

Figure 3:
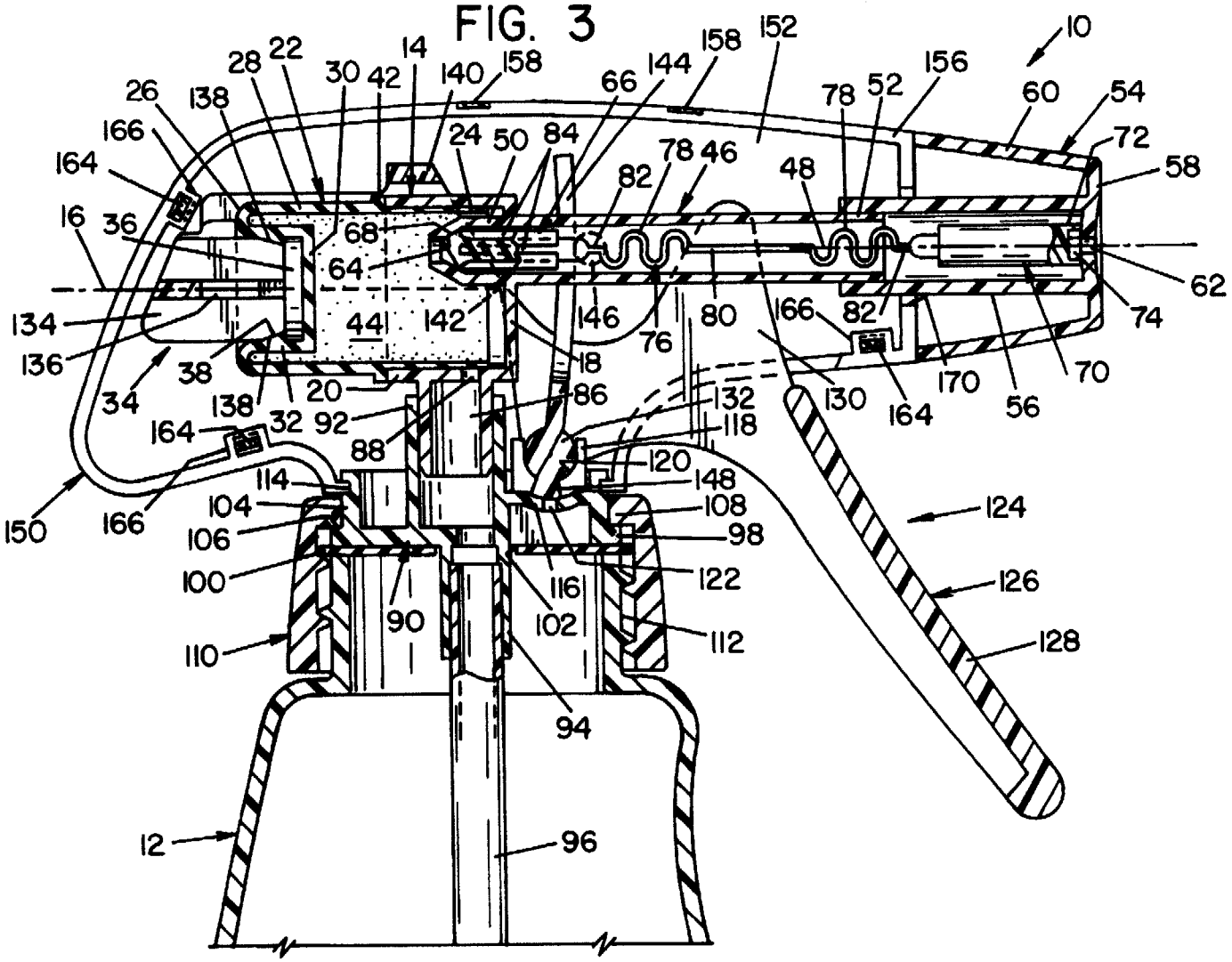
FIG. 3 is a sectional elevation view of the sprayer looking in the direction of line 3—3 in FIG. 2.
Figure 4:
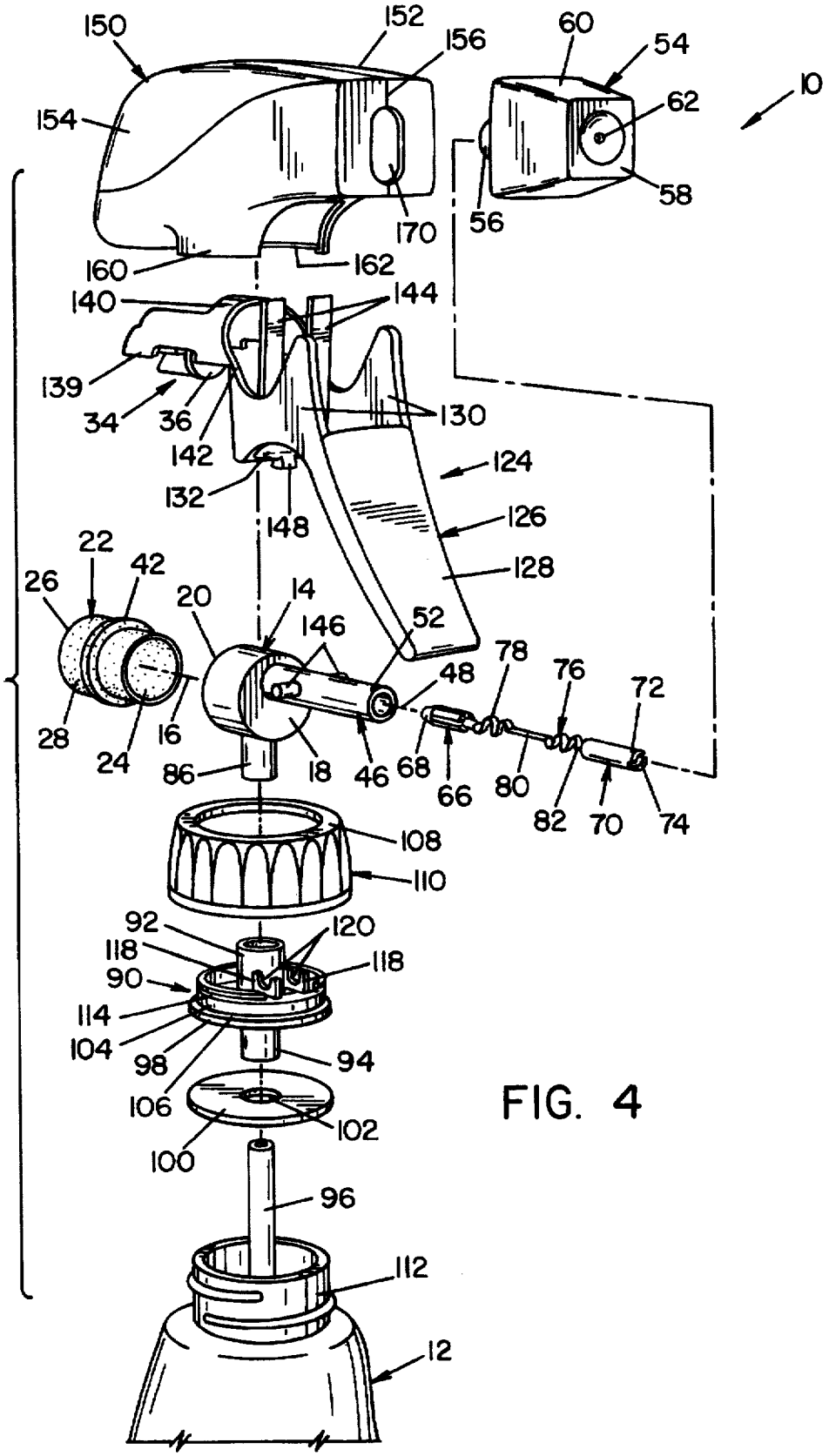
FIG. 4 is an exploded perspective view of the component parts of the sprayer.
Figure 5:
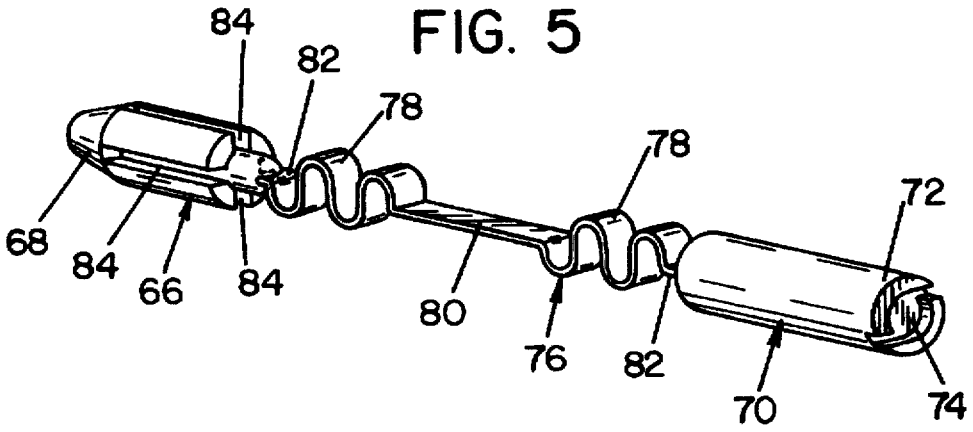
FIG. 5 is a front perspective view of the spinner and spring valve component of the sprayer.

In operation, operating arm 128 of trigger 126 is pivotally displaced about the axis of pivot pin 132 in the direction toward container 12 and such pivotal displacement of the trigger imparts linear axial displacement of actuator member 34 and thus the closed end of pump diaphragm 22 to the right in FIG. 3 toward front wall 18 of pump cylinder 14. Such displacement of the closed end of the pump diaphragm provides the discharge stroke for the pump and pressurizes fluid in pump chamber 44 whereupon valve member 66 is displaced to the right in FIG. 3 out of engagement with valve seat 64 and against the bias of spring 76. Thus, the fluid under pressure in chamber 44 flows through outlet conduit 46 and nozzle tube 56, laterally inwardly through swirl passageways 74 in spinner member 70 and thence through discharge opening 62 in nozzle 54. More particularly with regard to the axial linear displacement of actuating member 34, the location of hinges 142 is generally vertically above the axis of pivot pin 132 and provides a hinge pivot axis parallel to the axis of pin 132. Moreover, the hinge pivot axis is in a horizontal plane generally through pump axis 16, and these hinge features provide for translating the pivotal displacement of lever 126 into linear axial displacement of actuating member 34 and thus the closed end of pump diaphragm 22. Furthermore, during this pivotal displacement of trigger 126, spring fingers 144 engage against projections 146 whereby such pivotal displacement of the trigger is against the bias of the spring fingers which thus provide a return force for returning the component parts to the positions shown in FIG. 3 upon release of the trigger following a spray dispensing operation thereof. More particularly in this respect, when trigger 126 is released the spring fingers bias the latter to pivot counter clockwise in FIG. 3 about the axis of pivot pin 132 whereupon hinges 142 operate to translate such pivotal displacement into linear axial displacement of actuating member 34 and thus the closed end of pump diaphragm 22 to the left of FIG. 3 away from cylinder wall 18. When the fluid pressure in pump chamber 44 is reduced by the flow of fluid through the outlet conduit during the spray dispensing operation, spring 76 biases valve element 66 to the left in FIG. 3 for end 68 thereof to engage seat 64 to close the discharge conduit. The displacement of the closed end of pump diaphragm 22 away from cylinder wall 18 following a spray dispensing operation provides the suction stroke for the pump during which fluid in container 12 is drawn upwardly through dip tube 96 and into pump chamber 44 through inlet 88. Further in this respect, the flexibility of the material of diaphragm 22 allows the portion thereof overlying inlet opening 88 to be displaced upwardly therefrom in response to the pressure drop across the inlet opening during the suction stroke of the pump. When trigger 126 is pivoted clockwise in FIG. 3 toward supply container 12, valve 148 on the underside of pivot pin 132 is moved to undercover vent passageway 122, thus venting the interior of container 12 to atmosphere, and when the trigger returns to its initial position shown in FIG. 3, valve 148 closes vent passageway 122 so as to preclude any accidental flow of fluid from the container if, for example, the container is laid or falls onto its side during periods of non-use.

Figure 9:
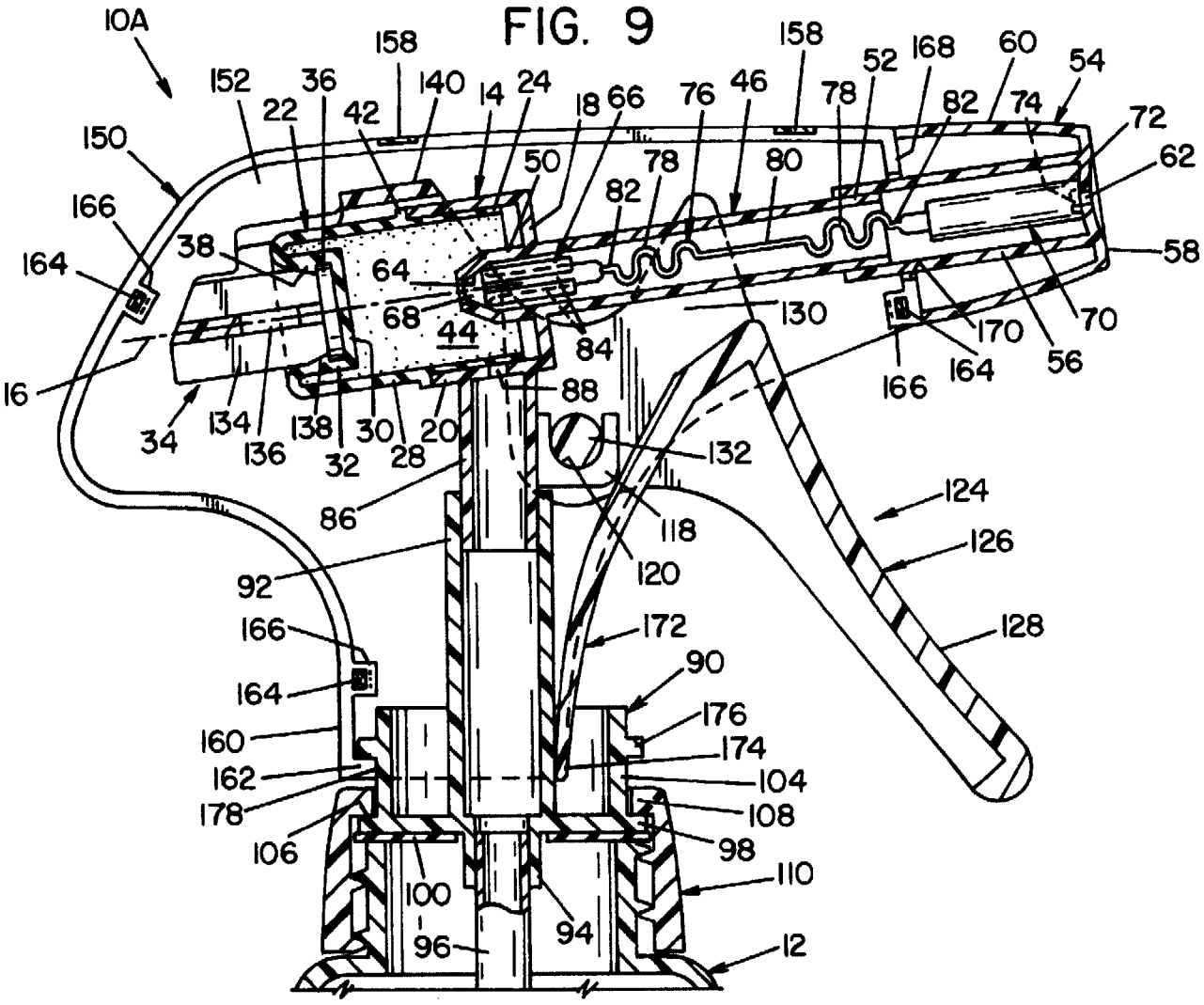
FIG. 9 is a sectional elevation view similar to FIG. 3 and illustrating modifications of certain component parts of the sprayer.

FIG. 9 illustrates a trigger sprayer 10A which is structurally similar in many respects to the trigger sprayer described above in connection with FIGS. 1–8. Accordingly, like numerals appear in FIG. 9 to designate parts corresponding to those of the earlier embodiment. In this embodiment, the sprayer has a greater vertical height relative to cap member 110 than in the previous embodiment and, in this respect, pump inlet conduit 86 and upper conduit portion 92 of retainer member 90 are each longer than the corresponding component in the earlier embodiment. Further, cradle members 118 for trigger pivot pin 132 are provided on inlet conduit 86 in this embodiment, and trigger 126 is modified to provide operating arm 128 thereof with an integral spring finger 172 having a lower end 174 slidably engaging upper conduit portion 92 of retainer member 90. A further modification resides in the fact that discharge conduit 46 is coaxial with pump cylinder axis 16 as opposed to being offset therefrom as in the early embodiment. Further, the lower front portions of housing members 152 and 154, only the former of which is visible in FIG. 9, are open between front wall 168 and shroud portion 160 to accommodate operating arm 128 and spring finger 170 of the trigger, and the lower ends of the shroud portion of each housing member includes a radially inwardly extending flange 162 which, when the housing halves are in the closed position thereof, have a circumferential angular extent of greater than 180° so as to preclude lateral separation thereof from wall 104 of retainer member 90. Further in this embodiment, wall 104 of retainer member 90 is provided with a radially outwardly extending peripheral flange 176 which, together with the upper side of flange 108 of cap member 110, provides an annular recess 178 for receiving housing member flanges 162.

Operation of the trigger sprayer of this embodiment is the same as that of the earlier embodiment with respect to the pivotal displacement of trigger 126 in opposite directions about the axis of trigger pivot pin 132 imparting linear axial reciprocation to actuating member 34 and thus linear axial displacement of end wall 30 of the pump diaphragm toward and away from front wall 18 of the pump cylinder. With further regard to the latter displacement of the trigger and the closed end of the pump diaphragm, and as is applicable to both embodiments herein disclosed, pivotal displacement of trigger 126 in first and second opposite directions relative, for example, to nozzle 54 respectively displaces end wall 30 of pump diaphragm 22 in the direction opposite the corresponding one of the first and second directions. Thus, pivotal displacement of trigger 126 to the left in FIG. 9 and thus away from nozzle 54 causes linear axial displacement of end wall 30 of pump diaphragm 22 to the right in FIG. 9 and thus toward nozzle 54. Similarly, pivotal displacement of lever 126 to the right in FIG. 9 and thus toward nozzle 54 causes end wall 30 of pump diaphragm 22 to be linearly axially displaced to the left in FIG. 9 and thus away from nozzle 54.

FIGS. 10–13 illustrate a trigger sprayer 10B which is also structurally similar in many respects to the trigger sprayer described in connection with FIGS. 1–8 whereby like numerals appear in FIGS. 10–13 to designate the parts corresponding to those of the earlier embodiment. In this embodiment, as in the embodiment of FIG. 9, discharge conduit 46 is coaxial with pump cylinder axis 16, and the major modifications relate to structural features of retainer member 90, trigger and pump actuating mechanism 124 and housing 150. More particularly in this respect, as will become apparent hereinafter, the retainer member and housing cooperatively support the trigger and pump actuating mechanism for pivotal displacement of the trigger and include component parts interengaging with the pump cylinder and diaphragm to axially stabilize the diaphragm. Further, the retainer member and housing have a snap-lock interengagement by which the component parts are maintained in assembled relationship relative to one another and to the cap member by which the sprayer is removably mounted on a supply container.

Figure 10:
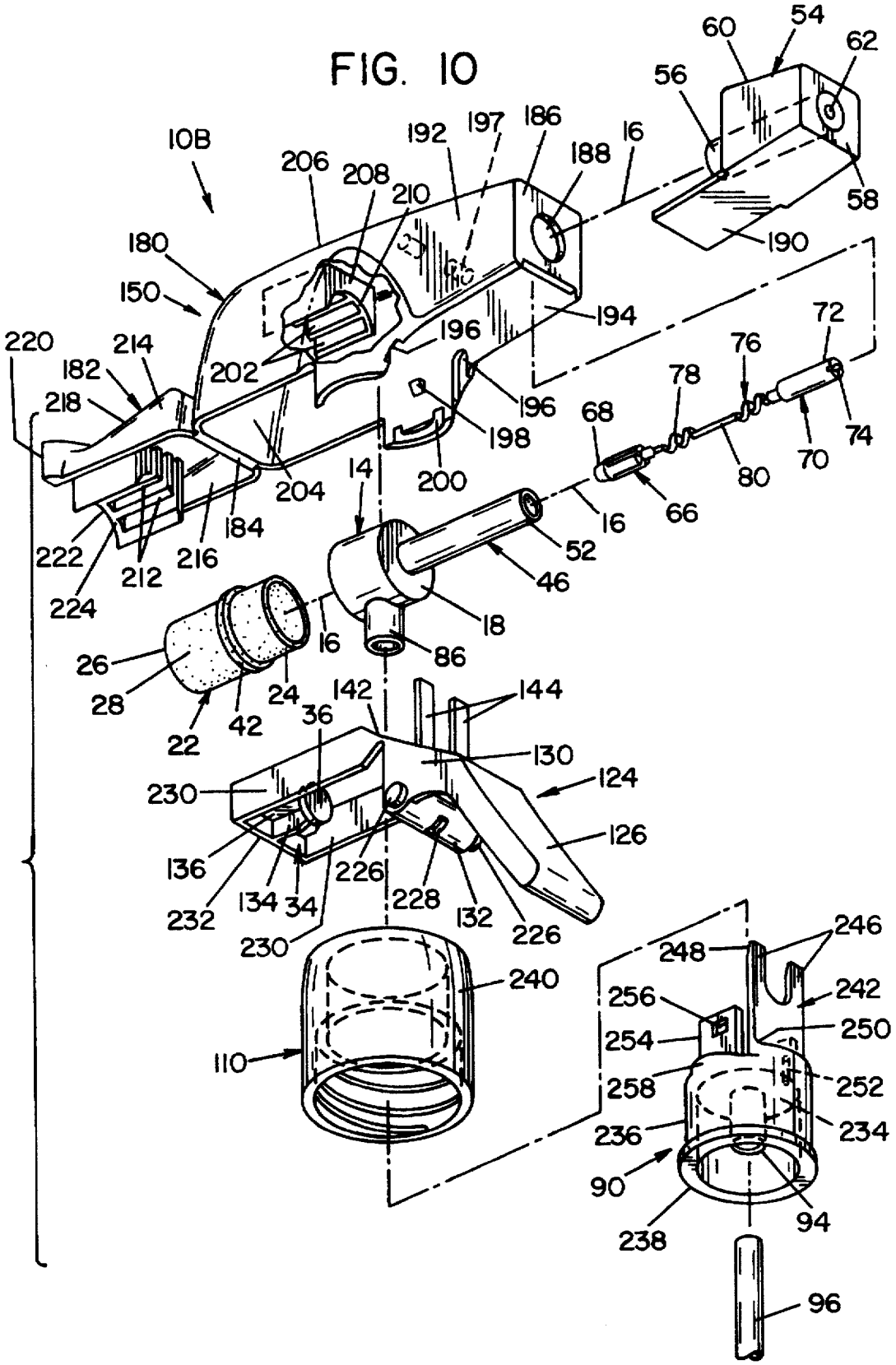
FIG. 10 is an exploded perspective view of the component parts of another embodiment of the invention.

With regard first to housing 150, the latter is a one-piece molding of suitable plastic material which in this embodiment comprises a top housing member 180 and a bottom housing member 182 pivotally interconnected by a live hinge 184 extending laterally across the rear end of the housing transverse to axis 16. Top housing member 180 includes a front wall 186 having an aperture 188 therethrough receiving support tube 56 of nozzle component 54, and the latter is modified to provide for the bottom wall thereof to include an extension 190 which underlies the open bottom at the front end of top housing member 180 when the component parts of the sprayer are in assembled relationship. Nozzle member 54 is also modified to provide resilient projections 191 on diametrically opposite sides of nozzle tube 56 so as to pass through opening 188 and engage against the inner side of front wall 186 of top housing member 180 to optimize retention of the nozzle component on the housing. As shown in FIG. 10, and for the purposes set forth more fully hereinafter, the laterally spaced apart side walls 192 and 194 of top housing member 180 are provided on the inner sides thereof with laterally aligned arcuate bearing surfaces 196, laterally inwardly extending projections 198 and arcuate recesses 200. Also for the purposes set forth hereinafter, top housing member 180 is provided with a plurality of integral ribs 202 laterally spaced apart between side walls 192 and 194 and spaced forwardly from rear wall 204 of the housing member and extending downwardly from top wall 206 thereof. The forward ends of ribs 202 terminate in a laterally extending flange 208 having an arcuate inner surface 210 coaxial with axis 16. Likewise, bottom housing member 182 is provided with a plurality of ribs 212 laterally spaced apart between side walls 214 and 216 of the bottom housing member and extending upwardly from bottom wall 218 thereof. Bottom housing member 182 includes a front wall 220, which is arcuate relative to an axis transverse to axis 16, and when the housing members are closed the forward ends of ribs 212 terminate in a laterally extending flange 222 spaced rearwardly from front wall 220 and having an arcuate inner surface 224 coaxial with axis 16. Each of the arcuate surfaces 210 and 224 has a radius corresponding to that of the outer surface of pump diaphragm 22 behind flange 42 thereof and, as best seen in FIGS. 11 and 13, when the housing members are closed flanges 208 and 222 engage behind flange 42 of the pump diaphragm.

Trigger and pump actuating mechanism 124 is modified in this embodiment by providing pivot pin extensions 226 extending outwardly from the laterally opposite sides of the trigger member coaxial with trigger pivot pin 132. Further, pivot pin 132 is provided with a relief recess 228 for the purpose set forth hereinafter. Further, vertical and horizontal plates 134 and 136 supporting inner end 36 of pump actuator element 34 are interconnected with actuating legs 230 in this embodiment by a T-shaped rear plate 232 extending transversely between the legs, and the bridging portion between the legs in the embodiment of FIGS. 1–8 is eliminated.

Retainer member 90 in this embodiment includes an annular wall 234 from which coaxial upper and lower conduits 92 and 94 extend. As in the previous embodiments, upper conduit 92 extends into cylinder inlet tube 86 and lower conduit 94 receives dip tube 96. Retainer member 90 further includes an annular skirt 236 extending downwardly from wall 234 and terminating in a radially outwardly extending peripheral flange 238 by which the sprayer is mounted on a supply container by means of cap member 110 which, preferably, has an upper wall portion 240 surrounding skirt 236 and terminating coplanar with the top side of wall 234.

Figure 11:
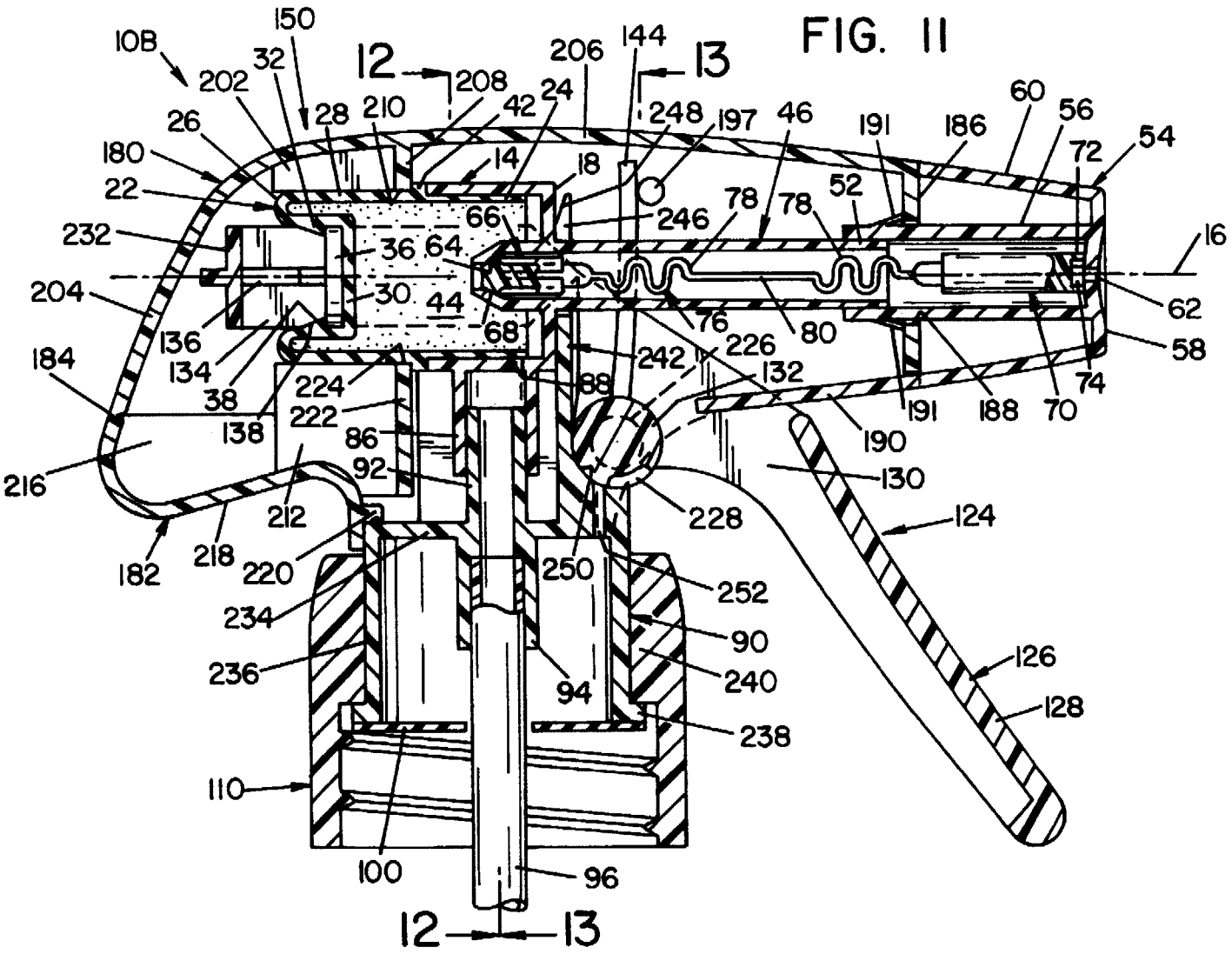
FIG. 11 is a longitudinal sectional elevation view of the assembled sprayer for which the component parts are shown in FIG. 10.

As best seen in FIGS. 11 and 13, the front end of retainer member 90 is provided with a wedging plate 242 extending upwardly from wall 234 and having a U-shaped recess in the upper end thereof, providing wedging fingers 246 on laterally opposite sides of discharge conduit 46. Wedging plate 242 and fingers 246 tightly engage against the axially outer side of front wall 18 of pump cylinder 14 and axially bias the latter to the left in FIG. 11, thus axially compressing diaphragm flange 42 between the inner end of the pump cylinder and flanges 208 and 222 provided in the top and bottom housing members as described hereinabove. Preferably, the upper ends of wedging fingers 246 are tapered as indicated at 248 to facilitate displacement of the fingers upwardly along the front wall of the cylinder during assembly of the component parts as set forth hereinafter. The lower end of wedging plate 242 and the corresponding area of the upper side of wall 234 underlie trigger pivot pin 132, and the juncture therebetween is contoured to provide an arcuate surface 250 of the same radius as that of pivot pin 132. As mentioned hereinabove, pivot pin 132 is provided with a relief recess 228, and wall 234 of retainer member 90 is provided with a vent passageway 252 which is closed to atmosphere by pivot pin 132 when trigger 126 is in the position thereof following the intake stroke of the pump. Upon pivotal displacement of trigger 126 clockwise in FIG. 11 to displace the pump through its discharge stroke, relief recess 228 communicates the interior the supply container with atmosphere through vent passageway 252 to vent the interior of the container. As will be appreciated from FIGS. 10, 11 and 13, arcuate surface 25 on retainer member 90 and journal surfaces 196 inside top housing member 180 cooperatively capture trigger pivot pin 132 and pin extensions 226 to pivotally support the trigger and pump actuating mechanism.

As best seen in FIGS. 10 and 12, the laterally opposite sides of retainer member 90 are provided with locking fingers 254 extending upwardly from wall 234 adjacent the inner sides of side walls 192 and 194 of top cover member 180. The upper ends of fingers 254 are provided with openings 256 adapted to receive the corresponding one of the projections 198 on the inner sides of the housing walls, and the lower ends of the fingers are provided with recesses 258 which cooperatively interengage with the corresponding one of the recesses 200 in the housing walls for the purpose set forth hereinafter. The inner sides of side walls 192 and 194 of top housing member 180 are also provided with laterally inwardly extending projections 197 which, as best seen in FIG. 11, are positioned forwardly of spring fingers 144 on trigger pivot pin 132 and thus replace projections 146 provided on laterally opposite sides of discharge tube 46 in the embodiment of FIGS. 1–8.

Assembly of the component parts of the sprayer in this embodiment is achieved as follows. The pump unit as defined by cylinder 14, discharge tube 46 and pump diaphragm 22 and the pump actuating mechanism 124 are preassembled as a unit. Top and bottom housing portions 180 and 182 are opened to the positions thereof shown in FIG. 10 and are positioned upside down on a suitable support surface, and the preassembled pump and trigger unit is inserted downwardly thereinto such that trigger pivot projections 226 engage in arcuate bearing surfaces 196, spring fingers 144 engage behind pins 197, and diaphragm flange 42 engages forwardly of flange 208 with diaphragm wall 28 seating in arcuate surface 210 of flange 208. Bottom housing member 182 is then pivoted about live hinge 184 to its closed position relative to top housing member 180 and in which flange 222 is positioned behind diaphragm flange 42 with arcuate surface 224 seating about wall 28 of the diaphragm. Retainer member 90 with cap member 110 thereon is then pushed into the housing from the underside thereof, whereupon wedging plate 242 and fingers 246 thereof engage against the outer side of front wall 18 of cylinder 14 pressing the latter rearwardly to axially capture diaphragm flange 42 between the inner end of cylinder 18 and flanges 208 and 222 of the housing members. During such insertion of the retainer member, upper conduit 92 thereon enters inlet tube 86 of cylinder 14 and legs 254 of the retainer member are cammed inwardly by projections 198 on the upper housing member until openings 256 in the legs move into alignment with the projections. Upon such alignment, projections 198 enter openings 256 to latch the retainer member and upper housing member. Also during such insertion of the retainer member, recesses 258 interengage with recesses 200 on the inner sides of the side walls of the top housing member whereby, when the assembly is complete, lateral outwardly flexing of the side walls of top housing member 180 relative to retainer member 90 is effectively restrained.

As will be appreciated from FIG. 11, when lower housing member 182 is closed relative to top housing member 180, front wall 220 of the lower housing member overlies wall 234 of retainer member 90 whereby, when the retainer member interlocks with top housing member 180, bottom housing member 182 is securely held in its closed position by the engagement between front wall 220 and retainer wall 234. The assembly is then completed by inserting nozzle tube 56 through opening 188 in front wall 186 of top housing member 180 to receive the front end of discharge tube 46 and to position resilient fingers 191 behind the front wall to axially retain nozzle member 54 on housing member 180. The sprayer is then ready for assembly with a supply container by inserting a dip tube 96 in lower conduit 94 of retaining member 90 and then mounting the sprayer on the threaded upper end of the supply container through the use of nut member 110.

While considerable emphasis has been placed herein on preferred embodiments and on the structures and the structural interrelationships between component parts thereof, it will be appreciated that many embodiments of the invention can be made and that many changes can be made in the embodiments disclosed herein without departing from the principles of the invention. In particular in this respect, it will be appreciated that the trigger and pump actuating assembly for translating displacement of the trigger into linear axial displacement of the pump actuating component to achieve fluid discharge along a path parallel to the pump axis would be operable with pump arrangements other than the preferred rollable diaphragm type pump. Furthermore, in conjunction with the rollable diaphragm or other type of variable volume pump, the pivotal interconnection between the trigger and pump actuating component can be provided other than by an integral or live hinge therebetween and, moreover, can be provided by appropriate translating linkage between a reciprocating trigger and reciprocating pump actuator. Still further, it will be appreciated that the housing members can be completely separated from one another as opposed to being hingedly joined together and can be provided with appropriate interengaging snap fastener components for maintaining the housing members closed about the components parts which are supported in assembled relationship relative to the retaining member. These and other modifications of the preferred embodiments as well as other embodiments of the invention will be obvious and suggested to those skilled in the art, whereby it is to be distinctly understood that the foregoing descriptive matter is to be interpreted merely as illustrative of the invention and not as a limitation.

Having thus described the invention, it is claimed:

1. A manually operable sprayer for mounting on a supply container comprising nozzle means including a discharge opening having an axis, variable volume pump means having a pump axis parallel to said axis of said discharge opening and having axially spaced apart fixed and movable end means, said fixed end means facing said nozzle means, means providing an inlet for connecting said pump means with fluid in said supply container, means providing an outlet for connecting said pump means with said discharge opening, said movable end means being linearly axially displaceable toward and away from said fixed end means for pumping fluid from said container through said outlet and discharge opening, trigger means displaceable relative to said nozzle means in axially opposite first and second directions, means for interconnecting said trigger means and said movable end means for displacement of said trigger means in said first and second directions to respectively displace said movable end means linearly in the direction opposite said first and second directions, said means for interconnecting said trigger means and said movable end means including actuator means connected to said movable end means, and means for pivotally interconnecting said actuator means and said trigger means.

2. A sprayer according to claim 1, wherein said trigger means is pivotal relative to said nozzle means about a trigger axis, and said means for pivotally interconnecting said trigger means and said actuator means pivotally interconnects said trigger means and said actuator means along a pivot axis spaced from said trigger axis.

3. A sprayer according to claim 1, wherein said means for pivotally interconnecting said actuator means and said trigger means includes hinge means.

4. A sprayer according to claim 3, wherein said hinge means is integral with said trigger means and said actuator means.

5. A sprayer according to claim 4, wherein said hinge means has a hinge axis, and said trigger means is pivotal about a trigger axis spaced from and parallel to said hinge axis.

6. A sprayer according to claim 1, further including first and second housing members, and means for interconnecting said housing members to enclose said pump means, a portion of said trigger means and said means for interconnecting said trigger means and said movable end means.

7. A sprayer according to claim 6, wherein said means for interconnecting said housing members includes hinge means therebetween supporting said housing members for relative displacement between open and closed positions, and means for holding said housing members in said closed position.

8. A sprayer according to claim 7, and means including retainer means for removably mounting said pump means, said trigger means and said means for interconnecting said trigger means and said movable end means on said supply container as a unit, and said retainer means including means interengaging with said housing members in said closed position thereof to retain said housing means in a mounted position relative to said unit.

9. A sprayer according to claim 1, wherein said pump means includes a cylinder coaxial with said pump axis and having axially opposite ends, an end wall at one of said ends and the other of said ends being open, a cylindrical pump member coaxial with said pump axis and having open and closed ends and flexible wall means between said ends thereof, said open end of said pump member being in said cylinder adjacent said end wall thereof, and said mean interconnecting said trigger means and said movable end-means including actuator means connected to said closed end of said pump member.

10. A sprayer according to claim 9, wherein said closed end of said pump member includes an end wall transverse to said pump axis and a re-entrant portion of said flexible wall means integral with said end wall.

11. A sprayer according to claim 10, wherein said actuator means includes an actuator end received in said re-entrant portion of said wall means, and said actuator end and said re-entrant portion including interengaging means interengaging for axial displacement of said actuator means in opposite directions to axially roll said flexible wall means relative to said actuator end.

12. A sprayer according to claim 11, wherein said trigger means is pivotal relative to said cylinder about a trigger axis, and means for pivotally interconnecting said trigger means and said actuator means along a pivot axis spaced from said trigger axis.

13. A sprayer according to claim 12, wherein said means for pivotally interconnecting said actuator means and said trigger means includes hinge means.

14. A sprayer according to claim 13, wherein said hinge means is integral with said trigger means and said actuator means.

15. A sprayer according to claim 14, wherein said hinge means includes a hinge axis spaced from said trigger axis and pivotal thereabout with said trigger means.

16. A sprayer according to claim 13, wherein said trigger axis is below said cylinder adjacent said end wall thereof and said trigger means includes an upper end spaced above said trigger axis and displaceable with said trigger means about said trigger axis, and actuator arm means extending from said actuator means in the direction toward said cylinder end wall and having end means pivotally connected to said upper end of said trigger means by said hinge means.

17. A sprayer according to claim 9, wherein said outlet for said pump means includes means providing an outlet opening through said end wall of said cylinder, and conduit means for connecting said outlet opening with said discharge opening in said nozzle.

18. A sprayer according to claim 17, wherein said outlet opening and conduit means have an axis laterally offset from said pump axis.

19. A sprayer according to claim 17, wherein said means providing an outlet opening through said cylinder end wall includes means providing a valve seat, check valve means in said conduit means having engaged and disengaged positions relative to said valve seat, and means biasing said check valve means toward said engaged position.

20. A sprayer according to claim 19, wherein said means biasing said check valve means includes spring means in said conduit means having an end connected to said check valve means and having an opposite end, and a spinner member connected to said opposite end and extending between said opposite end and said discharge opening in said nozzle means.

21. A sprayer according to claim 20, wherein said spinner member includes means for imparting a spinning motion to fluid pumped through said discharge opening.

22. A sprayer according to claim 9, wherein said inlet for said pump means includes an aperture in said cylinder, said flexible wall means at the open end of said pump member closing said aperture against the flow of fluid therethrough from said cylinder and opening said aperture in response to the flow of fluid from said supply container to said cylinder.

23. A sprayer according to claim 1, wherein said means providing an inlet for connecting said pump means with fluid in said supply container includes inlet conduit means, said trigger means being pivotally displaceable in said first and second directions and including pivot pin means, and said inlet conduit means including cradle means pivotally supporting said pivot pin means.

24. A sprayer according to claim 23, wherein said trigger means includes biasing finger means and said sprayer further includes means interengaging with said finger means to bias said trigger means in one of said first and second directions.

25. A sprayer according to claim 24, wherein said means providing an outlet for connecting said pump means with said discharge opening includes outlet conduit means, said means interengaging with said finger means including abutment means on said outlet conduit means.

26. A sprayer according to claim 25, wherein said outlet conduit means has opposite sides and said abutment means includes an abutment on each of said opposite sides, said finger means including a pair of fingers each interengaging with a different one of said abutments.

27. A sprayer according to claim 26, wherein said finger means is integral with said pivot pin means.

28. A sprayer according to claim 24, wherein said finger means is integral with said pivot pin means.

29. A sprayer according to claim 23, wherein said inlet conduit means includes means providing a vent passageway between said supply container and atmosphere and said trigger means includes means for opening said vent passageway in one of said first and second positions and closing said vent passageway in the other of said positions.

30. A sprayer according to claim 29, wherein aid means for opening and closing said vent passageway includes a valve member pivotally displaceable with said pivot pin means.

31. A sprayer according to claim 1, wherein said trigger means is pivotal relative to said nozzle means about a trigger axis, and hinge means pivotally interconnecting said trigger means and said actuator means along a hinge axis spaced from said trigger axis, said trigger means, actuator means and hinge means comprising a single molding of plastic material.

32. A sprayer according to claim 31, wherein said trigger axis is below said pump means adjacent said fixed end means and said trigger means includes an upper end spaced above said trigger axis and displaceable with said trigger means about said trigger axis, said actuating means including an actuator member coaxial with said pump means and connected to said movable end means, and actuator arm means extending from said actuator member in the direction toward said fixed end means and having end means pivotally connected to said upper end of said trigger means by said hinge means.

33. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, retainer means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, and means including trigger means for linearly displacing said closed end of said diaphragm toward and away from said front wall of said cylinder for pumping fluid from said container through said outlet tube and discharge opening, said cylinder including an inlet conduit integral therewith and having a conduit axis transverse to said cylinder axis, said retaining means including a retaining member and said inlet conduit means including a conduit portion on said retaining member coaxial with said conduit axis, said retaining member including radially outwardly extending mounting flange means, means including said retaining member for removably mounting said sprayer on said supply container, said retainer member supporting said pump cylinder, said pump diaphragm, said outlet conduit means, said nozzle means, said trigger means and said means for displacing said closed end of said diaphragm as a unitary assembly, first and second housing members separate from said assembly, and means for mounting said housing members on said assembly to enclose said assembly, said housing members having axially spaced apart front and rear ends with respect to said cylinder axis and the direction between said front and rear ends of said cylinder, said housing members being laterally displaceable relative to one another between an open position and a closed position in which said housing members enclose said assembly, said housing members having lower ends including mounting flange means, and said means for mounting said housing members including said mounting flange means on said housing members and said mounting flange means on said retainer member interengaging therewith.

34. A sprayer according to claim 33, wherein said front ends of said housing members are adjacent said nozzle means and include corresponding first and second front walls transverse to said outlet conduit means, each said first and second front walls having a lateral recess therein for receiving a portion of said outlet conduit means when said housing members are in said closed position.

35. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, retainer means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, means including trigger means for linearly displacing said closed end of said diaphragm toward and away from said front wall of said cylinder for pumping fluid from said container through said outlet conduit means and discharge opening, said trigger means being supported on said retainer means for pivotal displacement about a trigger pivot axis, said trigger means including an operating arm having an end below said pivot axis and actuating arm means having end means spaced above said pivot axis, said means for linearly displacing said closed end of said diaphragm including actuating means, and means interconnecting said actuating means and said end means of said actuating arm means for pivotal displacement of said trigger means in opposite directions about said pivot axis to linearly reciprocate said actuating means.

36. A sprayer according to claim 35, wherein said actuating means includes an actuating member transverse to said cylinder axis and interconnected with said closed end of said diaphragm, and leg means extending from said actuating member in the direction toward said front wall of said cylinder and having end means, and said means interconnecting said actuator means and said end means of said actuating arm means including hinge means between said end means of said actuating arm means and said end means of said leg means.

37. A sprayer according to claim 36, wherein said trigger means, actuating means and hinge means comprise a single molding of plastic material.

38. A sprayer according to claim 35, and means for biasing said trigger means to pivot in the direction corresponding to said displacement of said closed end of said diaphragm away from said front wall of said cylinder.

39. A sprayer according to claim 38, wherein said means for biasing said trigger means includes resilient finger means on said trigger means and abutment means on said outlet conduit means.

40. A sprayer according to claim 38, wherein said means for biasing said trigger means includes resilient finger means on said trigger means having end means interengaging with said inlet conduit means.

41. A sprayer according to claim 35, wherein said trigger means includes a pivot pin means providing said trigger pivot axis, and said retainer means includes cradle means pivotally supporting said pin.

42. A sprayer according to claim 41, wherein said retainer means includes a retainer member comprising an retainer portion and a radially outwardly extending wall portion having upper and lower sides relative to said cylinder, said means pivotally supporting said pin being on said upper side of said wall portion.

43. A sprayer according to claim 42, wherein said radially outwardly extending wall portion includes a vent passageway between said supply container and atmosphere, said vent passageway being beneath said pivot pin, and said pivot pin including means to open and close said vent passageway in response to pivotal movement of said pin in opposite directions about said pivot pin axis.

44. A sprayer according to claim 42, wherein said trigger pivot axis is below said outlet conduit means and in a vertical plane forwardly of said front wall of said cylinder, resilient finger means on said trigger pivot pin extending upwardly adjacent laterally opposite sides of said outlet conduit means, and abutment means on said laterally opposite sides of said outlet conduit means interengaging with said finger means to bias said trigger means to pivot in the direction corresponding to said displacement of said closed end of said diaphragm away from said front wall of said cylinder.

45. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, retainer means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, and means including trigger means for linearly displacing said closed end of said diaphragm toward and away from said front wall of said cylinder for pumping fluid from said container through said outlet tube and discharge opening, said pump diaphragm including a cylindrical side wall between said open and closed ends thereof, and said closed end comprising an end wall transverse to said cylinder axis and a re-entrant portion of said cylindrical side wall.

46. A sprayer according to claim 45, wherein said means for displacing said closed end of said diaphragm includes an actuator component coaxial with said cylinder axis and axially reciprocable relative to said cylinder, said actuator component having an inner end in said re-entrant portion and an outer end spaced therefrom, whereby reciprocation of said actuator component imparts a rolling displacement of said side wall of said diaphragm along said actuator component in opposite directions with respect to said inner and outer ends thereof.

47. A sprayer according to claim 46, wherein said re-entrant portion and said inner end of said actuator component include means interengaging to restrain separation thereof during displacement of said actuator component away from said front wall of said cylinder.

48. A sprayer according to claim 47, wherein said closed end of said diaphragm is spaced outwardly from said open end of said cylinder, and said cylindrical side wall of said diaphragm has an outer surface including means engaging said open end of said cylinder to axially position said open end of said diaphragm relative to said front wall of said cylinder.

49. A sprayer according to claim 45, wherein said cylinder includes an inlet opening transverse to said cylinder axis and spaced from said front wall of said cylinder, a portion of the cylindrical side wall of said diaphragm adjacent said open end thereof overlying said inlet opening to preclude the flow of fluid from said chamber through said inlet opening.

50. A sprayer according to claim 49, wherein said closed end of said diaphragm is spaced outwardly from said, open end of said cylinder, and said cylindrical side wall of said diaphragm has an outer surface including means engaging said open end of said cylinder to axially position said open end of said diaphragm relative to said front wall of said cylinder.

51. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, retainer means including inlet conduit means for connecting said chamber with fluid in said supply container, outlet conduit means extending axially forwardly from said front wall of said cylinder and having an outer end spaced forwardly from said front wall, nozzle means attached to said outer end of said outlet conduit means and having a discharge opening, and means including trigger means for linearly displacing said closed end of said diaphragm toward and away from said front wall of said cylinder for pumping fluid from said container through said outlet conduit means and discharge opening.

52. A sprayer according to claim 51, wherein said outlet conduit means includes an outlet conduit having an inner end in said cylinder adjacent said front wall thereof and an outer end spaced outwardly from said front wall, said nozzle means including an outlet tube coaxial with and interconnected with said outer end of said outlet conduit, said discharge opening being coaxial with said outlet tube, said inner end of said outlet conduit providing a valve seat, and check valve means in said outlet conduit including a valve member axially displaceable between engaged and disengaged positions relative to said valve seat, and means biasing and valve member toward said engaged position.

53. A sprayer according to claim 52, and a spinner member in said outlet tube, and having an outer ed engaging said nozzle means about said discharge opening said outer end of said spinner member including means for imparting a spinning motion to fluid pumped through said discharge opening.

54. A sprayer according to claim 53, wherein said means biasing said valve member includes compression spring means between said valve member and said spinner member.

55. A sprayer according to claim 54, wherein said outlet conduit has an axis offset from and parallel to said cylinder axis.

56. A sprayer according to claim 51, wherein said cylinder includes an inlet conduit integral therewith and having a conduit axis transverse to said cylinder axis, said retaining means including a retaining member and said inlet conduit means including a conduit portion on said retaining member coaxial with said conduit axis, and said retaining member including radially outwardly extending mounting flange means, and means including said retaining member for removably mounting said sprayer on said supply container.

57. A sprayer according to claim 56, wherein said retainer member supports said pump cylinder, said pump diaphragm, said outlet conduit means, said nozzle means, said trigger means and said means for displacing said closed end of said diaphragm as a unitary assembly.

58. A sprayer according to claim 57, further including first and second housing members separate from said assembly, and means for mounting said housing members on said assembly to enclose said assembly.

59. A sprayer according to claim 58, wherein said housing members have axially spaced apart front and rear ends with respect to said cylinder axis and the direction between said front and rear ends of said cylinder, said housing members being laterally displaceable relative to one another between an open position and a closed position in which said housing members enclose said assembly.

60. A sprayer according to claim 59, wherein said housing members in said closed position have a line of juncture therebetween between said front and rear ends thereof, and hinge means interconnecting said housing members along said line of juncture for pivotal displacement between said open and closed positions thereof.

61. A sprayer according to claim 60, wherein said housing members have means interengaging along said line of juncture to hold said housing members in said closed position thereof.

62. A manually operable sprayer for mounting on a supply container comprising, a pump cylinder having a cylinder axis and axially spaced apart front and rear ends,a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, retainer means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, means including trigger means for linearly displacing said closed end of said diaphragm toward and away from said front wall of said cylinder for pumping fluid from said container through said outlet tube and discharge opening, said trigger means being supported on said retainer means for pivotal displacement about a trigger pivot axis, said trigger means including an operating arm having an end below said pivot axis and actuating arm means having end means spaced above said pivot axis, said means for linearly displacing said closed end of said diaphragm including an actuating member coaxial with said cylinder and interconnected with said closed end, and leg means extending from said actuating member toward said front wall of said cylinder and having end means hingedly connected to said end means of said actuating arm means for pivotal displacement of said trigger means in opposite directions about said pivot axis to linearly reciprocate said actuating member, said pump diaphragm including a cylindrical side wall between said open and closed ends thereof, said closed end comprising an end wall transverse to said cylinder axis and a re-entrant portion of said cylindrical side wall, said actuating member having an inner end in said re-entrant portion and an outer end spaced therefrom, whereby reciprocation of said actuating member imparts a rolling displacement of said side wall of said diaphragm along said actuating member in opposite directions with respect to said inner and outer ends thereof.

63. A sprayer according to claim 62, wherein said cylinder includes an inlet opening transverse to said cylinder axis spaced from said front wall of said cylinder, a portion of the cylindrical side wall of said diaphragm adjacent said open end thereof overlying said inlet opening to preclude the flow of fluid from said chamber through said inlet opening.

64. A sprayer according to claim 63, and means including resilient finger means on said trigger means for biasing said trigger means to pivot in the direction corresponding to the displacement of said closed end of said diaphragm away from said front wall of said cylinder.

65. A sprayer according to claim 64, wherein said retainer means includes a retainer member including a wall having a vent passageway between said supply container and atmosphere, said trigger means including a pivot pin providing said pivot axis, said retainer member including means pivotally supporting said pin, said vent passageway being beneath said pivot pin, and said pivot pin including means to open and close said vent passageway in response to pivotal movement of said pin in opposite directions about said pivot pin axis.

66. A sprayer according to claim 66, wherein said retainer member supports said cylinder, said outlet conduit mean, said nozzle means, said trigger means and said means for displacing said closed end of said diaphragm as a unitary assembly.

67. A sprayer according to claim 66, further including first and second housing members separate from said assembly, and means for mounting said housing members on said assembly to enclose said assembly, and wherein said housing members have axially spaced apart front and rear ends with respect to said cylinder axis and the direction between said front and rear ends of said cylinder, said housing members being laterally displaceable relative to one another between an open position and a closed position in which said housing members enclose said assembly.

68. A sprayer according to claim 67, wherein said housing members in said closed position have a line of juncture therebetween between said front and rear ends thereof, and hinge means interconnecting said housing members along said line of juncture for pivotal displacement between said open and closed positions thereof, said housing members having lower ends including mounting flange means, and said means for mounting said housing members includes said mounting flange means on said housing members and mounting flange means on said retainer member interengaging therewith.

69. A sprayer according to claim 68, wherein said outlet conduit means includes an outlet conduit having an inner end in said cylinder adjacent said front wall thereof and an outer end spaced outwardly from said front wall, said nozzle means including an outlet tube coaxial with and interconnected with said outer end of said outlet conduit, said discharge opening being coaxial with said outlet tube, said inner end of said outlet conduit providing a valve seat, and check valve means in said outlet conduit including a valve member axially displaceable between engaged and disengaged positions relative to said valve seat, and means biasing and valve member toward said engaged position.

70. A sprayer according to claim 69, and a spinner member in said outlet tube and having an outer end engaging said nozzle means about said discharge opening, said outer end of said spinner member including means for imparting a spinning motion to fluid pumped through said discharge opening, and said means biasing said valve member including compression spring means between said valve member and said spinner member.

71. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, means including retainer member means for mounting said sprayer on said supply container, said retainer member means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, actuating means including trigger means for linearly displacing said closed end of said diaphragm toward and away from said front wall of said cylinder for pumping fluid from said container through said outlet tube and discharge opening, said pump cylinder, pump diaphragm, outlet conduit means and actuating means being an assembled unit, housing means receiving said assembled unit, said housing means and said retainer member means including interengaging means for mounting said unit in said housing means, said housing means including a top housing member having first and second side walls on laterally opposite sides of said cylinder axis, said first and second side walls respectively having first and second inner surfaces, said retainer member means including an arcuate surface transverse to and spaced below said cylinder axis, said trigger means including pivot pin means providing a trigger axis transverse to said cylinder axis, and said first and second inner surfaces including means cooperable with said arcuate surface to support said pivot pin means for displacement about said trigger axis.

72. A sprayer according to claim 71, wherein said retainer member means includes a vent passageway through said arcuate surface, said pivot pin means including a pin portion engaging said arcuate surface, and said pin portion including a recess for covering and uncovering said passageway in response to pivotal displacement of said pivot pin means in opposite directions about said trigger axis.

73. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open end in said cylinder and a closed end transverse to said cylinder axis and axially spaced from said front wall of said cylinder, said cylinder and said diaphragm providing a pump chamber, means including retainer member means for, mounting said sprayer on said supply container, said retainer member means including inlet conduit means for connecting said chamber with fluid in said supply container, outlet conduit means extending axially forwardly from said front wall of said cylinder and having an outer end spaced from said front wall, nozzle means attached to said outer end of said outlet conduit means and having a discharge opening, actuating means including trigger means for linearly displacing said closed end of said diaphragm toward and away from said front wall of said cylinder for pumping fluid from said container through said outlet tube and discharge opening, said pump cylinder, pump diaphragm, outlet conduit means and actuating means being an assembled unit, housing means receiving said assembled unit, and said housing means and said retainer member means including interengaging means for mounting said unit in said housing means.

74. A sprayer according to claim 73, wherein said trigger means is pivoted about a trigger axis and said housing means and said retainer member means include means cooperatively supporting said trigger means for pivoted displacement about said trigger axis.

75. A sprayer according to claim 73, wherein said housing means includes top and bottom housing members having open and closed positions relative to one another, said unit being mounted in said top housing member, and said retainer member means including means for holding said bottom housing member in said closed position relative to said top housing member.

76. A sprayer according to claim 73, wherein said housing means includes side wall means on laterally opposite sides of said cylinder axis, and said housing means and said retainer member means include interengaging means for restraining displacement of said wall means laterally outwardly of said cylinder axis.

77. A sprayer according to claim 73, wherein said housing means includes a top housing member having first and second side walls on laterally opposite sides of said cylinder axis, said first and second side walls respectively having first and second inner surfaces, said retainer member means including a wall parallel to and spaced below said cylinder axis and laterally spaced apart first and second fingers extending upwardly from said wall respectively adjacent said first and second inner surfaces, and said interengaging means including interengaging latch and keeper means on said first and second fingers and said first and second inner surfaces.

78. A sprayer according to claim 77, wherein said latch and keeper means includes projection means on said first and second inner surfaces and openings in said first and second fingers.

79. A sprayer according to claim 73, wherein said pump diaphragm includes a peripheral flange between said open and closed ends thereof and having a front end engaging against said rear end of said cylinder, said flange having a rear end, said housing means including arcuate wall means engaging against said rear end of said flange, and said retainer member means including plate means engaging against said front wall of said cylinder to bias said rear end of said cylinder toward said arcuate wall means of said housing.

80. A sprayer according to claim 73, wherein said pump diaphragm includes a peripheral flange between said open and closed ends thereof and engaging against said rear end of said cylinder, and said housing means and said retainer member means including means for biasing said flange against said rear end of said cylinder.

81. A manually operable sprayer for mounting on a supply container comprising, a pump cylinder having a cylinder axis and axially spaced apart front and rear ends, a front wall at said front end and said rear end being open, a cylindrical pump diaphragm coaxial with said cylinder and having an open in said cylinder and a closed end transverse to said cylinder axis and axially spaced from said front wall of said cylinder, said cylinder and said diaphragm providing a pump chamber, means including retainer member means for mounting said sprayer on said supply container, said retainer member means including inlet conduit means for connecting said chamber with fluid in said supply container, outlet conduit means extending axially forwardly from said front wall of said cylinder and having an outer end spaced front said front wall, nozzle means attached to said outer end of said outlet conduit means and having a discharge opening, actuating means including trigger means for linearly displacing said closed end of said diaphragm toward and away from said front wall of said cylinder for pumping fluid from said container through said outlet tube and discharge opening, said pump cylinder, pump diaphragm, outlet conduit means and actuating means being an assembled unit, housing means receiving said assembled unit, said housing means and said retainer member means including interengaging means for mounting said unit in said housing means, said housing means including a top housing member having first and second side walls on laterally opposite sides of said cylinder axis, said first and second side walls respectively having first and second inner surfaces, said retainer member means including a wall parallel to and spaced below said cylinder axis and laterally spaced apart first and second fingers extending upwardly from said wall respectively adjacent said first and second inner surfaces, said interengaging means including interengaging latch and keeper means on said first and second fingers and said first and second inner surfaces, said pump diaphragm including a peripheral flange between said open and closed ends thereof and having a front end engaging against said rear end of said cylinder, said flange having a rear end, said housing means including arcuate wall means engaging against said rear end of said flange, and said retainer member means including plate means extending upwardly from said wall transverse to said cylinder axis and engaging against said front wall of said cylinder to bias said rear end of said cylinder toward said arcuate wall means of said housing.

82. A sprayer according to claim 81, wherein said retainer member means includes an arcuate surface between said plate means and said wall, said arcuate surface extending transverse to said cylinder axis, said trigger means including pivot pin means providing a trigger axis transverse to said cylinder axis, and said first and second inner surfaces including means cooperable with said arcuate surface to support said pivot pin means for displacement about said trigger axis.

83. A sprayer according to claim 82, wherein said retainer member means includes a vent passageway through said arcuate surface, said pivot pin means including a pin portion engaging said arcuate surface, and said pin portion including a recess for covering and uncovering said passageway in response to pivotal displacement of said pivot pin means in opposite directions about said trigger axis.

84. A sprayer according to claim 82, wherein said top housing member has front and rear ends and said housing means further includes a bottom housing member displaceable between open and closed positions relative to said top housing member, said bottom housing member in said closed position underlying said rear end of said top housing member and having front end means interengaging with said plate means for said retaining member means to maintain said bottom housing member in said closed position.

85. A sprayer according to claim 84, wherein each said top and bottom housing member has a rear wall transverse to said cylinder axis, and hinge means between the rear walls supporting said bottom housing member for displacement between said open and closed positions about a hinge axis transverse to said cylinder axis.

86. A sprayer according to claim 85, wherein said arcuate wall means includes a first arcuate wall on said top housing member and a second arcuate wall on said bottom housing member.

87. A sprayer according to claim 84, wherein said first and second fingers and said first and second inner surfaces further include means interengaging to restrain displacement of said first and second side walls laterally outwardly of said cylinder axis.

88. A sprayer according to claim 87, wherein said retainer member means includes a vent passageway through said arcuate surface, said pivot pin means including a pin portion engaging said arcuate surface, and said pin portion including a recess for covering and uncovering said passageway in response to pivotal displacement of said pivot pin means in opposite directions about said trigger axis.

89. A sprayer according to claim 88, wherein said latch and keeper means includes projections on said first and second inner surfaces and openings in said first and second fingers.

90. A sprayer according to claim 89, wherein each said top and bottom housing member has a rear wall transverse to said cylinder axis, and hinge means between the rear walls supporting said bottom housing member for displacement between said open and closed positions about a hinge axis transverse to said cylinder axis.

* * * * *